US011621118B2

(12) United States Patent
Nishimura et al.

(10) Patent No.: US 11,621,118 B2
(45) Date of Patent: Apr. 4, 2023

(54) COIL DEVICE

(71) Applicant: TDK CORPORATION, Tokyo (JP)

(72) Inventors: Munehito Nishimura, Tokyo (JP); Yoshihiro Kawasaki, Tokyo (JP); Masato Otsuka, Tokyo (JP); Taishi Kitamura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 403 days.

(21) Appl. No.: 16/782,148

(22) Filed: Feb. 5, 2020

(65) Prior Publication Data

US 2020/0251276 A1 Aug. 6, 2020

(30) Foreign Application Priority Data

Feb. 6, 2019 (JP) ..... JP2019-019937

(51) Int. Cl.
*H01F 27/24* (2006.01)
*H01F 27/29* (2006.01)
*H01F 27/28* (2006.01)

(52) U.S. Cl.
CPC ..... *H01F 27/29* (2013.01); *H01F 27/24* (2013.01); *H01F 27/2823* (2013.01)

(58) Field of Classification Search
CPC . H01F 27/306; H01F 3/08; H01F 3/14; H01F 5/06; H01F 17/04; H01F 27/266; H01F 27/29; H01F 27/324; H01F 2017/048; H01F 27/255; H01F 27/303; G05F 1/30; H02M 3/158; H02M 1/0064; H02M 1/009; H02M 3/1582; H02M 3/1584
See application file for complete search history.

(56) References Cited

U.S. PATENT DOCUMENTS 7,358,842 B1 * 4/2008 Liu ..... H01F 38/10 336/200
2002/0057160 A1 5/2002 Hanato et al.
2004/0155745 A1 * 8/2004 Wang ..... H01F 27/292 336/83
2004/0263285 A1 * 12/2004 Suzuki ..... H01F 41/082 333/185

(Continued)

FOREIGN PATENT DOCUMENTS

JP 2002-033228 A 1/2002
JP 2004-356473 A 12/2004

(Continued)

*Primary Examiner* — Mang Tin Bik Lian
(74) *Attorney, Agent, or Firm* — Oliff PLC

(57) ABSTRACT

A coil device includes a core including a winding core portion and a flange portion provided in an end portion of the winding core portion in an X-axis direction, a coil portion formed by a first wire and a second wire being wound around the winding core portion, and a first terminal electrode formed on one end side of the flange portion in a Y-axis direction, a first lead portion of the first wire being connected to the first terminal electrode, and a second terminal electrode formed on the other end side of the flange portion in the Y-axis direction, a second lead portion of the second wire being connected to the second terminal electrode. The width of the flange portion along X-axis-direction is different between one end and the other end of the flange portion in the Y-axis-direction.

19 Claims, 19 Drawing Sheets

(56) References Cited

U.S. PATENT DOCUMENTS

| | | | | |
|---|---|---|---|---|
| 2006/0170526 | A1* | 8/2006 | Okumura | H01F 27/292<br>336/208 |
| 2016/0133377 | A1* | 5/2016 | Takagi | H01F 27/29<br>29/605 |
| 2016/0240305 | A1* | 8/2016 | Igarashi | H01F 27/2828 |
| 2018/0019176 | A1* | 1/2018 | Kanbe | H01F 27/30 |
| 2018/0211763 | A1* | 7/2018 | Komaya | H01F 27/2828 |

FOREIGN PATENT DOCUMENTS

| | | | | |
|---|---|---|---|---|
| JP | 2006-049383 | A | * | 2/2006 |
| JP | 2008-091359 | A | | 4/2008 |
| JP | 2009-094389 | A | | 4/2009 |
| JP | 2009-147159 | A | | 7/2009 |

* cited by examiner

COIL DEVICE

BACKGROUND OF THE INVENTION

1. Field of the Invention

The present invention relates to a coil device.

2. Description of the Related Art

The wound common mode choke coil that is described in, for example, JP 2008-91359 A is known as a coil device used for an inductor or the like. The wound common mode choke coil described in JP 2008-91359 A includes a drum core including a winding portion (winding core portion) and a flange provided in an axial end portion of the winding portion (winding core portion). Two winding wires are wound around the outer peripheral surface of the winding portion. The respective winding terminals of the winding wires are drawn toward the mounting surface of the flange in a state of being close to each other on the side of the winding portion and respectively connected by thermocompression bonding or the like to two electrodes formed on the mounting surface.

In the wound common mode choke coil described in JP 2008-91359 A, the insulating film that covers each winding terminal may be melted by the heat of the thermocompression bonding during the thermocompression bonding of each winding terminal. The melting may lead to short circuit inferiority between the adjacent winding terminals.

SUMMARY OF THE INVENTION

The invention has been made in view of such a situation, and an object of the invention is to provide a coil device capable of preventing the occurrence of short circuit inferiority.

In order to achieve the object described above, a coil device according to the invention includes:

A coil device comprising:

a core including a winding core portion and a flange portion provided in an end portion of the winding core portion in a first direction;

a coil portion formed by a first wire and a second wire being wound around the winding core portion; and a first terminal electrode formed on one end side of the flange portion in a second direction substantially perpendicular to the first direction, a first lead portion of the first wire being connected to the first terminal electrode, and a second terminal electrode formed on the other end side of the flange portion in the second direction, a second lead portion of the second wire being connected to the second terminal electrode, wherein the width of the flange portion along the first direction is different between one end side and the other end side of the flange portion in the second direction.

In the coil device according to the invention, the width of the flange portion along the first direction is different between one end side and the other end side of the flange portion in the second direction. Accordingly, on one end side (or the other end side) of the flange portion in the second direction, where the width along the first direction is short, each of the first lead portion and the second lead portion can be drawn toward the respective terminal electrodes in a state of being sufficiently pulled apart along the first direction. Accordingly, on one end side (or the other end side) of the flange portion in the second direction, it becomes difficult for the first lead portion and the second lead portion to come into contact with each other and it is possible to prevent the occurrence of short circuit inferiority between the lead portions.

Preferably, a first recessed corner portion of a recessed corner portion where the winding core portion and the flange portion intersect with each other is designed to guide the first lead portion or the second lead portion, and is located closer to an outer end surface side of the flange portion along the first direction than a second recessed corner portion located on a side opposite to the first recessed corner portion across the winding core portion. With this configuration, in the periphery including the first recessed corner portion, each of the first lead portion and the second lead portion can be sufficiently pulled apart along the first direction and it is possible to effectively prevent contact between the first lead portion and the second lead portion.

Preferably, each of the first lead portion and the second lead portion is disposed so as to be separated along the first direction around the first recessed corner portion. With this configuration, in the periphery including the first recessed corner portion, each of the first lead portion and the second lead portion can be sufficiently pulled apart along the first direction and it is possible to effectively prevent contact between the first lead portion and the second lead portion as described above.

A projecting step portion may be formed at a position of the first recessed corner portion and the first lead portion may be drawn toward the first terminal electrode on one side of the step portion and the second lead portion may be drawn toward the second terminal electrode on the other side of the step portion. With this configuration, in the first recessed corner portion, the first lead portion and the second lead portion are isolated via the step portion and the first lead portion and the second lead portion are unlikely to come into contact with each other. Accordingly, it is possible to ensure a sufficient insulation between the first lead portion and the second lead portion and it is possible to prevent the occurrence of short circuit inferiority.

The step portion may extend along the first recessed corner portion. With this configuration, it is possible to form the step portion over a wide range at the position of the first recessed corner portion and it is possible to effectively ensure insulation between the first lead portion and the second lead portion via the step portion.

Preferably, a first inclined portion and a second inclined portion are formed on the flange portion, the first lead portion heading for the first terminal electrode passes through the first inclined portion, the second inclined portion extends at an angle different from an angle of the first inclined portion, and the second lead portion heading for the second terminal electrode passes through the second inclined portion. With this configuration, the first lead portion and the second lead portion can be easily drawn toward the first terminal electrode and the second terminal electrode along the first inclined portion and the second inclined portion.

In addition, the first lead portion passing through the first inclined portion and the second lead portion passing through the second inclined portion are drawn in different directions, and thus the first lead portion and the second lead portion can be sufficiently separated. Accordingly, it is possible to ensure a sufficient insulation between the first lead portion and the second lead portion.

Preferably, the first inclined portion extends toward a substantially central portion of the winding core portion in the second direction. With this configuration, the first lead portion can be drawn toward the first terminal electrode away from the winding core portion on the outer peripheral surface that is positioned between the substantially central and end portions of the winding core portion in the second direction. Accordingly, each of the first lead portion and the second lead portion can be drawn toward the terminal electrodes in a state of being sufficiently pulled apart along the second direction and contact between the first lead portion and the second lead portion can be effectively prevented.

Preferably, the first lead portion is made away from the winding core portion and drawn toward the first terminal electrode on an outer peripheral surface positioned between substantially central and end portions of the winding core portion in the second direction and the second lead portion is made away from the winding core portion and drawn toward the second terminal electrode in a periphery including the first recessed corner portion. In the case of this configuration, each of the first lead portion and the second lead portion is drawn at a different position along the second direction and contact between the first lead portion and the second lead portion can be effectively prevented.

Preferably, a part of a wall portion separating the first inclined portion and the second inclined portion from each other protrudes in the first direction from an inner end surface of the flange portion. In the case of this configuration, the first lead portion is drawn toward the first inclined portion so as to bypass a part of the wall portion protruding from the inner end surface of the flange portion. Accordingly, each of the first lead portion and the second lead portion is sufficiently pulled apart and contact between the first lead portion and the second lead portion can be effectively prevented.

Preferably, a part of an outer peripheral surface positioned between substantially central and end portions of the winding core portion in the second direction protrudes outward in a projecting shape in a cross section of the winding core portion. In the case of this configuration, the first lead portion is easily drawn toward the first terminal electrode from a part of the outer peripheral surface positioned between the substantially central and end portions of the winding core portion in the second direction. In addition, since a part of the outer peripheral surface of the winding core portion protrudes outward in a projecting shape, it is possible to ensure the cross-sectional area of the winding core portion by the amount of the protrusion and the inductance characteristics of the coil device can be improved.

Preferably, the first lead portion is drawn toward an outer end surface of the flange portion and connected to the first terminal electrode and the second lead portion is drawn toward an outer end surface of the flange portion at an angle different from an angle of the first lead portion and connected to the second terminal electrode.

DETAILED DESCRIPTION OF THE PREFERRED EMBODIMENTS

Figure 1A:
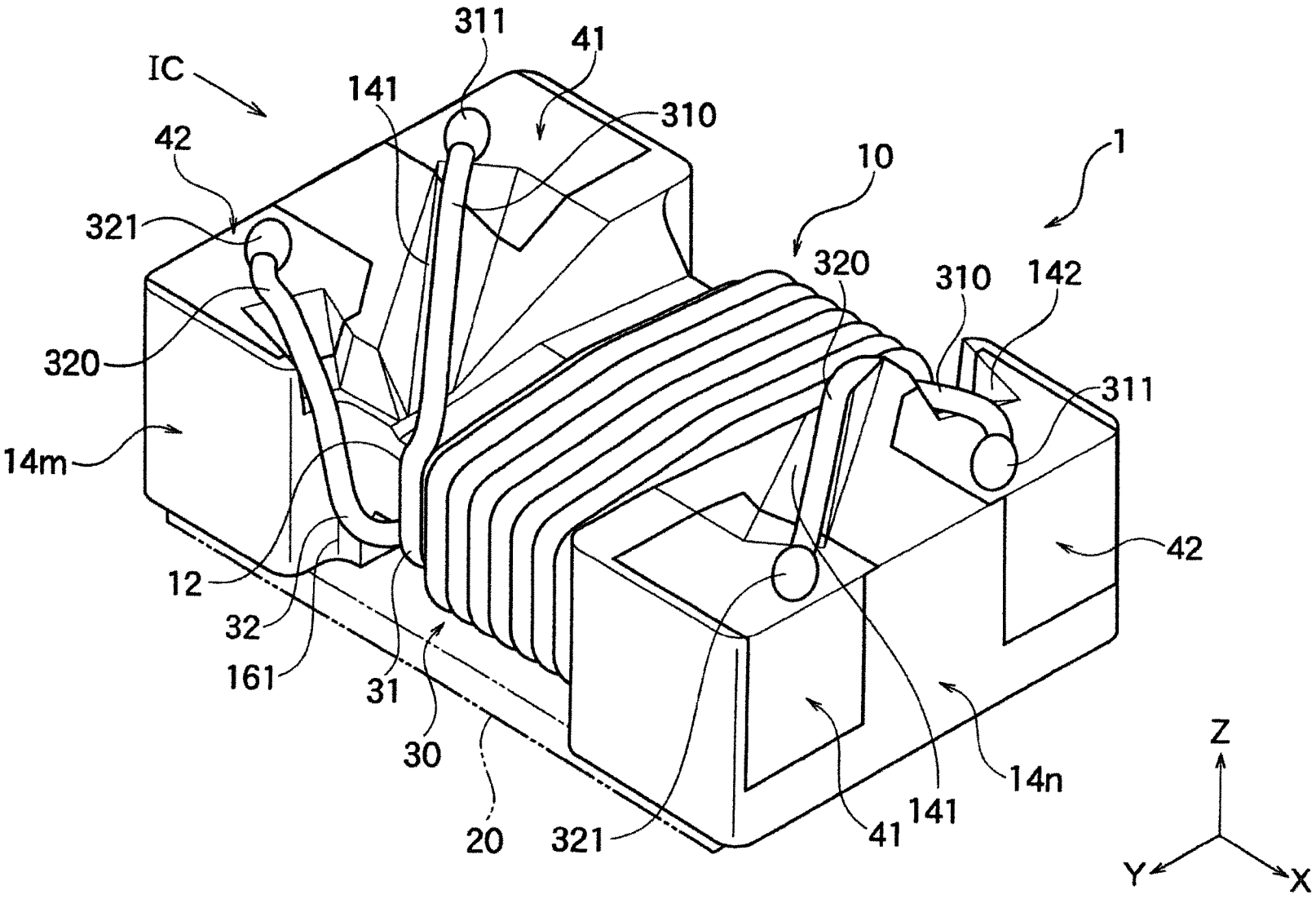
FIG. 1A is an overall perspective view of a coil device according to a first embodiment of the invention.

Hereinafter, the invention will be described based on embodiments illustrated in the drawings.

First Embodiment

As illustrated in FIG. 1A, a coil device 1 according to a first embodiment of the invention includes a drum core 10 and a coil portion 30 wound around a winding core portion 12 of the drum core 10.

In the following description, the X axis indicates a direction (first direction) parallel to the winding axis of the winding core portion 12 of the drum core 10 in a plane parallel to the mounting surface onto which the coil device 1 is mounted. The Y axis is a direction (second direction) perpendicular to the X axis and in a plane parallel to the mounting surface as in the case of the X axis. The Z axis is the normal direction of the mounting surface.

The drum core 10 includes the winding core portion 12 and a pair of flange portions 14*m* and 14*n* provided at both ends of the winding core portion 12 in the X-axis direction. One flange portion (first flange portion) 14*m* is provided in one end portion of the winding core portion 12 in the axial direction (first direction). The other flange portion (second flange portion) 14*n* is provided in the other end portion of the winding core portion 12 in the axial direction (first direction) and faces the flange portion 14*m*. Although the flange portions 14*m* and 14*n* have the same shape, the flange portions 14*m* and 14*n* may be different from each other. In the present embodiment, the flange portions 14*m* and 14*n* are disposed so as to be point-symmetric. In the following description, the flange portions 14*m* and 14*n* will be collectively referred to as "flange portion 14" in a case where it is not necessary to particularly distinguish the flange portions 14*m* and 14*n*.

Figure 1B:
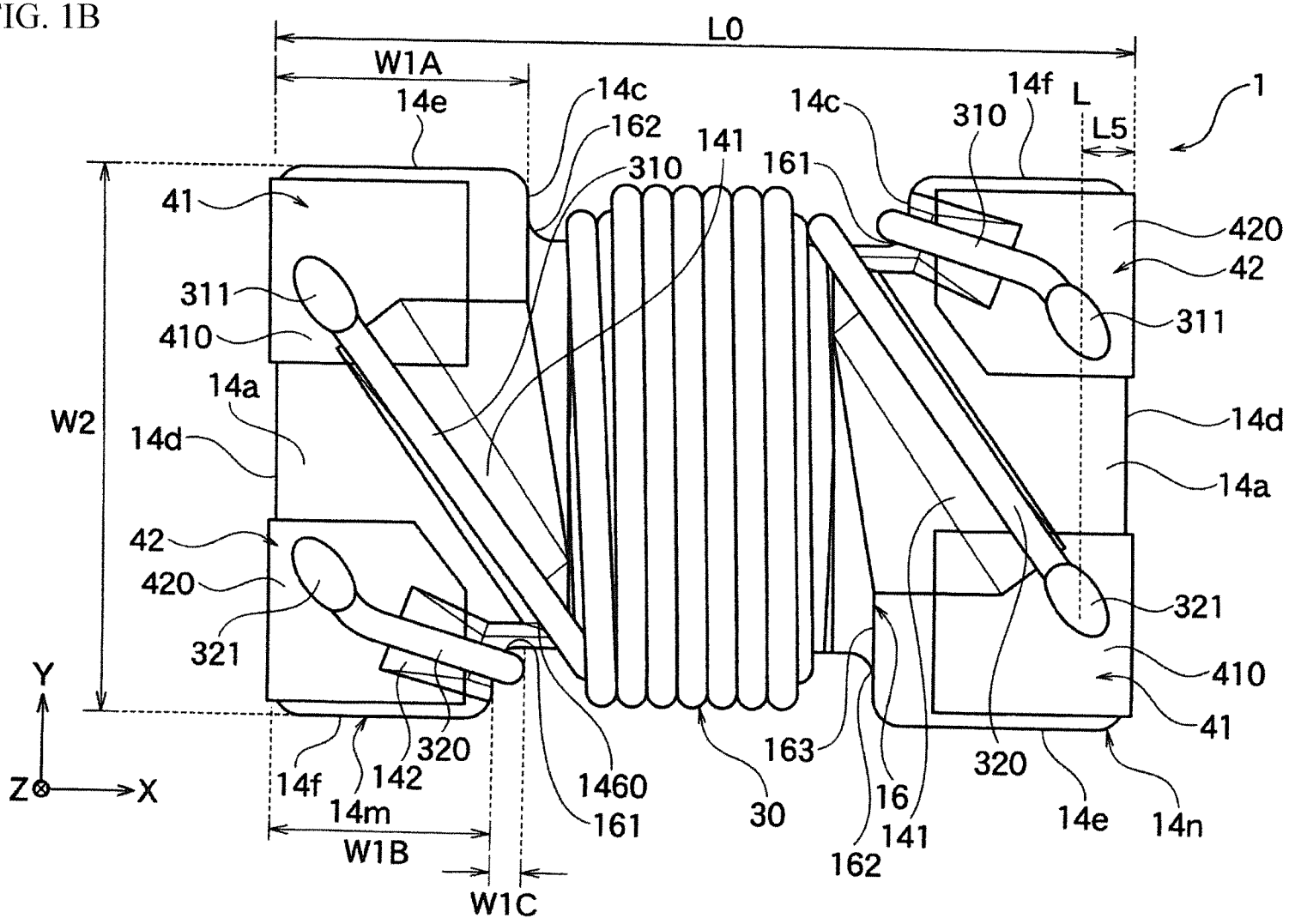
FIG. 1B is a plan view of the coil device illustrated in FIG. 1A.

Although the size of the drum core 10 (coil device 1) is not particularly limited, the drum core 10 (coil device 1) has an X-axis-direction length L0 of 1.15 to 1.35 mm, a Y-axis-direction width W2 of 0.9 to 1.1 mm, and a Z-axis-direction height H1 (see FIG. 1C) of 0.45 to 0.53 mm as illustrated in FIG. 1B. The ratio W6/W2 between a Y-axis-direction width W6 of the winding core portion 12 illustrated in FIG. 2A and the Y-axis-direction width W2 of the flange portions 14*m* and 14*n* illustrated in FIG. 1B is preferably 0.6 to 0.9.

The winding core portion 12 has a winding axis in the X-axis direction (first direction) and has a substantially hexagonal cross section elongated in the Y-axis direction (second direction). Although the cross-sectional shape of the winding core portion 12 is substantially hexagonal in the present embodiment, the cross-sectional shape may be rectangular, circular, or substantially octagonal and the cross-sectional shape is not particularly limited. In the following description, the outer peripheral surface positioned on the upper side of the winding core portion 12 will be referred to as the upper surface, the outer peripheral surface positioned on the lower side of the winding core portion 12 will be referred to as the lower surface, and the outer peripheral surface positioned on the side of the winding core portion 12 will be referred to as the side surface.

As illustrated in FIG. 1A, a first wire 31 and a second wire 32 are wound around the winding core portion 12 and the coil portion 30 is configured by the wires 31 and 32 being wound in one or more layers (two layers in the present embodiment). Coated conducting wires or the like constitute the wires 31 and 32 and the wires 31 and 32 have a configuration in which a core material made of a good conductor is covered with an insulating coating film. Although the cross-sectional areas of the conductor parts in the wires 31 and 32 are equal to each other in the present embodiment, the cross-sectional areas may be different from each other. In addition, the coil portion 30 may be configured by one wire being wound in one or more layers or may be configured by three or more wires being wound in one or more layers.

Although the numbers of windings of the wires 31 and 32 are approximately equal to each other in the present embodiment, the numbers may be different from each other depending on applications. The numbers of windings of the wires 31 and 32 being approximately equal to each other means that the ratio between the numbers of windings is in the range of 0.75 to 1/0.75 and the ratio is preferably 1.

The outer shape of each flange portion 14 is a substantially rectangular parallelepiped shape (substantially rectangular shape) that is long in the Y-axis direction and the flange portions 14 are disposed so as to be substantially parallel to each other at a predetermined interval in the X-axis direction. As illustrated in FIG. 1B, when the flange portion 14 is viewed from the mounting surface side (Z-axis upper side in the present embodiment), the flange portion 14 is formed such that the four corners of the flange portion 14 are rounded. The cross-sectional (YZ-cross-sectional) shape of the flange portion 14 may be circular or substantially octagonal and the cross-sectional shape is not particularly limited.

The flange portion 14 includes an upper surface 14*a*, a lower surface 14*b*, an inner end surface 14*c*, an outer end surface 14*d*, a first lateral side surface 14*e*, and a second lateral side surface 14*f*. The upper surface 14*a* is on the upper side of the flange portion 14. The lower surface 14*b* is on the side that is opposite to the upper surface 14*a*. The inner end surface 14*c* is on the winding core portion 12 side. The outer end surface 14*d* is on the side that is opposite to the inner end surface 14*c*. The first lateral side surface 14*e* is orthogonal to the upper surface 14*a* and the inner end surface 14*c* and is on the side of a first terminal electrode 41 (described later). The second lateral side surface 14*f* is orthogonal to the upper surface 14*a* and the inner end surface 14*c* and is on the side of a second terminal electrode 42 (described later).

In the present embodiment, the upper surface 14*a* serves as a mounting surface (ground surface) in a case where the coil device 1 is mounted onto a circuit board or the like. Although the second lateral side surface 14*f* of the first flange portion 14*m* and the first lateral side surface 14*e* of the second flange portion 14*n* are flush with each other in the illustrated example, there may be a deviation in the Y-axis direction between the lateral side surfaces 14*e* and 14*f*.

Figure 2A:
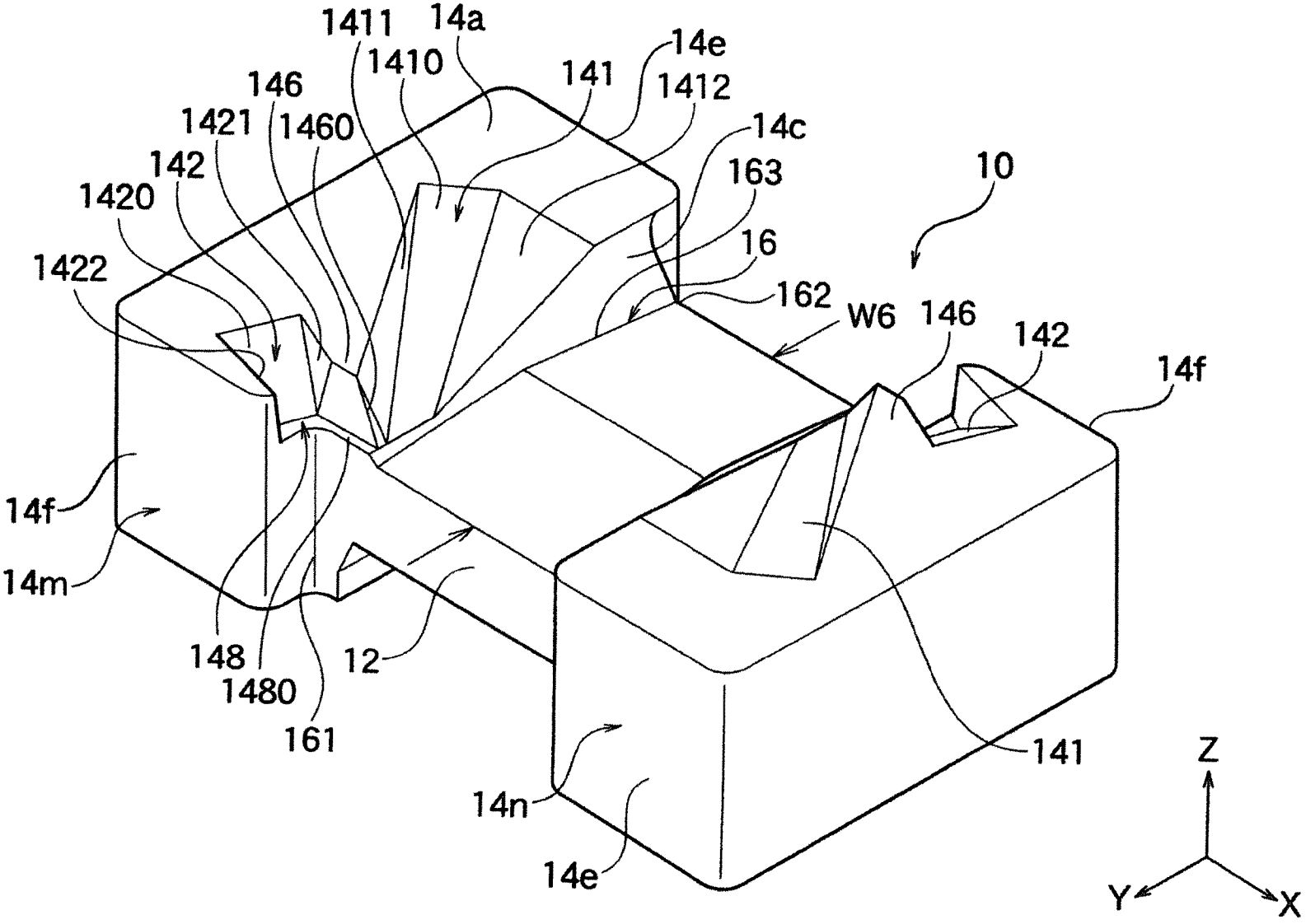
FIG. 2A is a perspective view illustrating a process of manufacturing the coil device illustrated in FIG. 1A.

As illustrated in FIG. 2A, a recessed corner portion 16 is formed at the position where the winding core portion 12 and the flange portion 14 intersect with each other. The recessed corner portion 16, which is an angular part, is formed by the outer peripheral surface of the winding core portion 12 and the inner end surface 14*c* of the flange portion 14. The recessed corner portion 16 is formed so as to go around the periphery of the winding core portion 12 along the outer peripheral direction of the winding core portion 12. In the following description, the recessed corner portion 16 that is formed by the inner end surface 14*c* of the flange portion 14 and the side surface of the winding core portion 12 (side surface on the second lateral side surface 14*f* side) will be referred to as a first recessed corner portion 161, the recessed corner portion 16 that is positioned on the side opposite to the first recessed corner portion 161 across the winding core portion 12 will be referred to as a second recessed corner portion 162, and the recessed corner portion 16 that is formed by the upper surface of the winding core portion 12 and the inner end surface 14*c* of the flange portion 14 will be referred to as a third recessed corner portion 163.

The first recessed corner portion 161 is positioned on the side where a first lead portion 310 or a second lead portion 320 (described later, see FIG. 1A) is raised toward the upper surface 14*a* of the flange portion 14 or the side away from the winding core portion 12 (side of the winding core portion 12). The second recessed corner portion 162 corresponds to the recessed corner portion that is formed by the inner end surface 14*c* of the flange portion 14 and the side surface of the winding core portion 12 (side surface on the first lateral side surface 14*e* side).

The first recessed corner portion 161 and the second recessed corner portion 162 constitute the side portion of the recessed corner portion 16 and are formed along the Z-axis direction (height direction of the flange portion 14). The third recessed corner portion 163 constitutes the upper portion of the recessed corner portion 16 and is formed along the Y-axis direction.

In the present embodiment, the width of the flange portion 14 along the X-axis direction is different between one end side and the other end side of the flange portion 14 in the Y-axis direction. In other words, when the X-axis-direction width of one end side of the flange portion 14 where the first terminal electrode 41 (described later) is positioned is W1A and the X-axis-direction width of the other end side of the flange portion 14 where the second terminal electrode 42 (described later) is positioned is W1B as illustrated in FIG. 1B, the width W1B of the other end side of the flange portion 14 along the X-axis direction is smaller than the width W1A of one end side of the flange portion 14 along the X-axis direction (W1B<W1A).

The width W1A of one Y-axis-direction end side of the flange portion 14 along the X-axis direction corresponds to the length between the outer end surface 14*d* of the flange portion 14 and a part of the inner end surface 14*c* positioned on one end side of the flange portion 14 in the Y-axis direction. In addition, the width W1B of the other end side of the flange portion 14 along the X-axis direction corresponds to the length between the outer end surface 14*d* of the flange portion 14 and a part of the inner end surface 14*c* positioned on the other end side of the flange portion 14 in the Y-axis direction.

The X-axis-direction width W1A of one Y-axis-direction end side of the flange portion 14 is preferably 0.45 cm to 0.51 cm. The X-axis-direction width W1B of the other Y-axis-direction end side of the flange portion 14 is shorter than the width W1A and is preferably 0.39 cm to 0.45 cm. The ratio W1B/W1A between the width W1B and the width W1A is preferably 0.7 or more and less than 1 and more preferably 0.8 or more and less than 0.9. The size of W1C, which is the difference between the width W1A and the width W1B, is preferably equal to or greater than the diameter of the first wire 31 or the second wire 32.

Since W1A exceeds W1B in the present embodiment, a part of the inner end surface 14*c* positioned on the other end side of the flange portion 14 in the Y-axis direction is disposed so as to positionally deviate to the outer end surface 14*d* side of the flange portion 14 along the X-axis direction as compared with a part of the inner end surface 14*c* positioned on one end side of the flange portion 14 in the Y-axis direction. The deviation width between a part of the inner end surface 14*c* positioned on the other end side of the flange portion 14 in the Y-axis direction and a part of the inner end surface 14*c* positioned on one end side of the flange portion 14 in the Y-axis direction corresponds to W1C, which is the difference between the widths W1A and W1B described above. Although the deviation width is approximately equal to the diameter of the second wire 32 in the illustrated example, the deviation width may be equal to or greater than the diameter.

In addition, the first recessed corner portion 161 as compared with the second recessed corner portion 162 positionally deviates to the outer end surface 14*d* side of the flange portion 14 along the X-axis direction. The deviation width between the first recessed corner portion 161 and the second recessed corner portion 162 corresponds to W1C, which is the difference between the widths W1A and W1B described above.

Figure 1C:
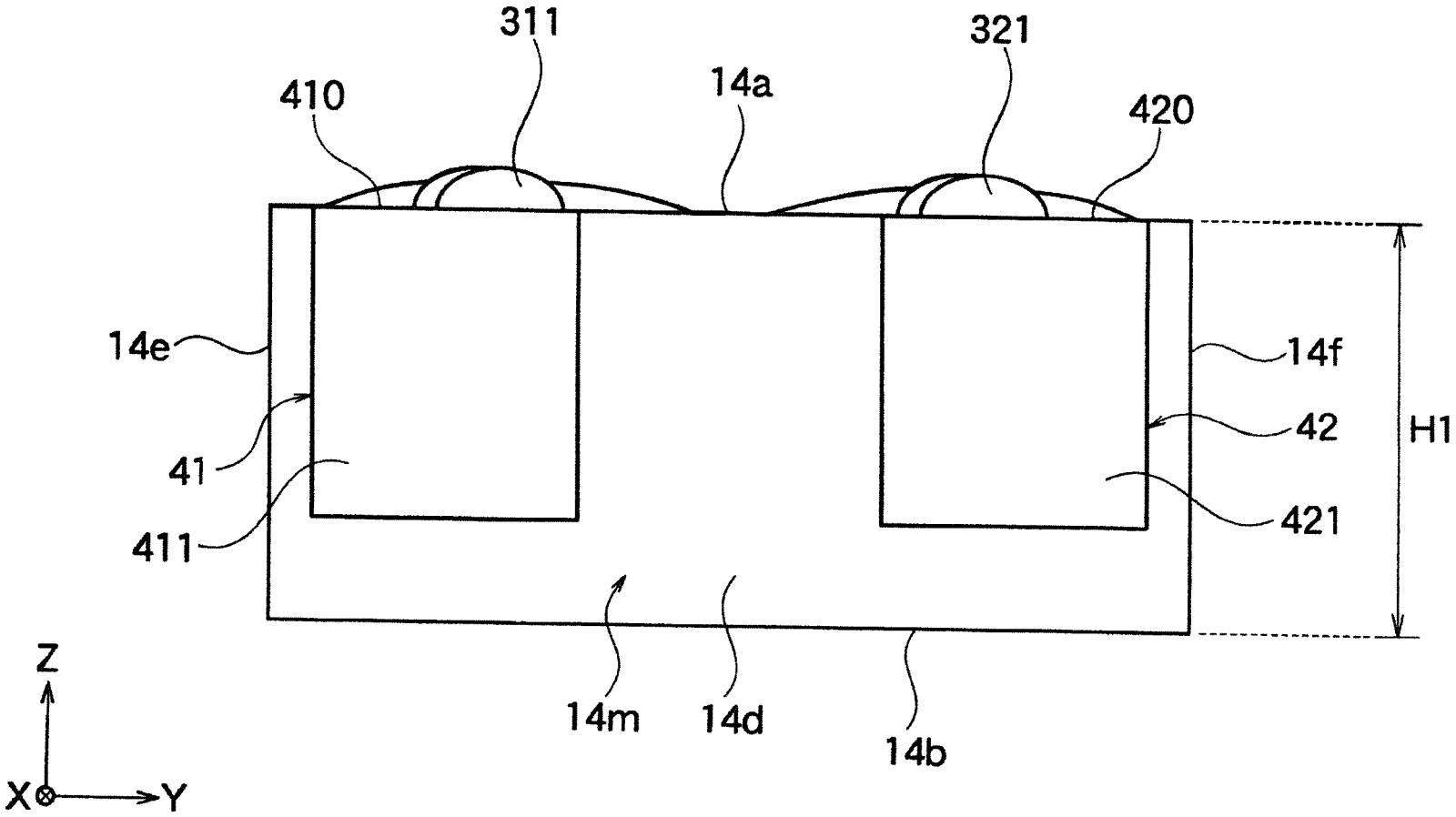
FIG. 1C a side view in which the coil device illustrated in FIG. 1A is viewed from the IC direction.

The first terminal electrode 41 is formed on the upper surface 14*a* (mounting surface) of the flange portion 14. The first terminal electrode 41 that is formed on the first flange portion 14*m* and the first terminal electrode (third terminal electrode) 41 that is formed on the second flange portion 14*n* are identical in configuration to each other. As illustrated in FIGS. 1B and 1C, in the present embodiment, the first terminal electrode 41 includes a first upper surface electrode portion 410 and a first side surface electrode portion 411, which are electrically connected. More specifically, the first upper surface electrode portion 410 has a surface parallel to the XY plane and is formed at one end of the upper surface 14*a* of the flange portion 14 in the Y-axis direction. A part of the first upper surface electrode portion 410 is formed so as to enter a first inclined portion 141 (described later). In addition, the first side surface electrode portion 411 has a surface parallel to the YZ plane and is formed on the end surface 14*d* of the flange portion 14. It is possible to form a sufficient solder fillet on the first terminal electrode 41 by forming the first side surface electrode portion 411 on the flange portion 14.

A first connecting portion 311, which is a part for connection to the first lead portion 310 of the first wire 31, is formed on the first upper surface electrode portion 410 formed on the first flange portion 14*m*. A second connecting portion 321, which is a part for connection to the second lead portion 320 of the second wire 32, is formed on the first upper surface electrode portion 410 formed on the second flange portion 14*n*. The connecting portions 311 and 321 are formed by thermocompression bonding of the lead portions 310 and 320 to the first upper surface electrode portion 410. In the present embodiment, the first upper surface electrode portion 410 also has a function as a mounting portion that is connected to face the surface of a circuit board (not illustrated). More specifically, the part of the first upper surface electrode portion 410 where the connecting portions 311 and 321 are not formed functions as a good bonding surface of solder with the electrode (land) of the circuit board.

In general, solder wettability declines at thermocompression-bonded part. Accordingly, it is preferable that the connecting portions 311 and 321 are disposed not at the center of the first upper surface electrode portion 410 but in the end portion of the first upper surface electrode portion 410. In this manner, it possible to ensure a sufficiently large area at the part of the first upper surface electrode portion 410 that is excellent in solder wettability and it is possible to increase the bonding strength (adhesion strength) between the coil device and the circuit board. In addition, it is possible to sufficiently ensure the strength of adhesion to the circuit board even in a case where the coil device 1 is reduced in size.

On the upper surface 14*a* (mounting surface) of the flange portion 14, the second terminal electrode 42 is formed at a predetermined interval (separated) from the first terminal electrode 41 along the Y-axis direction. The second terminal electrode 42 that is formed on the first flange portion 14*m* and the second terminal electrode (fourth terminal electrode) 42 that is formed on the second flange portion 14*n* are identical in configuration to each other. The interval between the first terminal electrode 41 and the second terminal electrode 42 is not particularly limited insofar as the distance ensures insulation.

In the present embodiment, the second terminal electrode 42 includes a second upper surface electrode portion 420 and a second side surface electrode portion 421, which are electrically connected. More specifically, the second upper surface electrode portion 420 has a surface parallel to the XY plane and is formed at the other end of the upper surface 14*a* of the flange portion 14 in the Y-axis direction (on the side opposite to the first upper surface electrode portion 410). A part of the second upper surface electrode portion 420 is formed so as to enter a second inclined portion 142 (described later). In addition, the second side surface electrode portion 421 has a surface parallel to the YZ plane and is formed on the end surface 14*d* of the flange portion 14. It is possible to form a sufficient solder fillet on the second terminal electrode 42 by forming the second side surface electrode portion 421 on the flange portion 14.

The second connecting portion 321, which is a part for connection to the second lead portion 320 of the second wire 32, is formed on the second upper surface electrode portion 420 formed on the first flange portion 14*m*. The first connecting portion 311, which is a part for connection to the first lead portion 310 of the first wire 31, is formed on the second upper surface electrode portion 420 formed on the second flange portion 14*n*. The connecting portions 311 and 321 are formed by thermocompression bonding of the lead portions 310 and 320 to the second upper surface electrode portion 420. In the present embodiment, the second upper surface electrode portion 420 also has a function as a mounting portion that is connected to face the surface of a circuit board (not illustrated). More specifically, the part of the second upper surface electrode portion 420 where the connecting portions 311 and 321 are not formed functions as a good bonding surface of solder with the electrode (land) of the circuit board.

It is preferable that the connecting portions 311 and 321 are disposed not at the center of the second upper surface electrode portion 420 but in the end portion of the second upper surface electrode portion 420. In this manner, it possible to ensure a sufficiently large area at the part of the second upper surface electrode portion 420 that is excellent in solder wettability and it is possible to increase the adhesion strength between the coil device and the circuit board. In addition, it is possible to sufficiently ensure the strength of adhesion to the circuit board even in a case where the coil device 1 is reduced in size.

In the present embodiment, the respective connecting portions 311 and 321 of the flange portions 14*m* and 14*n* are disposed at positions separated by a distance L5 in the X-axis direction from the outer end surface 14*d* of the flange portion 14. In other words, the positions of the connecting portions 311 and 321 are aligned along the X-axis direction and the connecting portions 311 and 321 are disposed on a straight line L, which extends in parallel to the Y axis.

The first terminal electrode 41 and the second terminal electrode 42 are made of, for example, a metal paste baking film or a metal plating film. The terminal electrodes 41 and 42 are formed by applying Ag paste or the like to the surfaces of the upper surface 14*a* and the outer end surface 14*d* of the flange portion 14, performing baking, and then forming plating films by performing electroplating, electroless plating, or the like on the surfaces.

The material of the metal paste is not particularly limited and examples of the material include Cu paste and Ag paste. In addition, the plating film may have a single layer or multiple layers and examples of the plating film include Cu, Ni, Sn, Ni—Sn, Cu—Ni—Sn, Ni—Au, and Au plating films. It is preferable that the thickness of the terminal electrodes 41 and 42, which is not particularly limited, is 0.1 to 15 μm.

As illustrated in FIG. 2A, the first inclined portion 141 and the second inclined portion 142 are formed in the flange portion 14. The first inclined portion 141 that is formed in the flange portion 14*m* and the first inclined portion (also referred to as "third inclined portion") 141 that is formed in the flange portion 14*n* are identical in configuration to each other. In addition, the second inclined portion 142 that is formed in the flange portion 14*m* and the second inclined portion (also referred to as "fourth inclined portion") 142 that is formed in the flange portion 14*n* are identical in configuration to each other. In the present embodiment, each of the inclined portions 141 and 142 formed in the flange portion 14*m* and each of the inclined portions 141 and 142 formed in the flange portion 14*n* are disposed so as to be point-symmetric.

The first inclined portion 141 and the second inclined portion 142 are separated from each other by a wall portion 146 formed in the flange portion 14. The wall portion 146 is positioned between the first inclined portion 141 and the second inclined portion 142. The wall portion 146 includes a tip acute angle portion 1460 having a pointed tip. The tip acute angle portion 1460 extends toward the Y-axis-direction end portion of the third recessed corner portion 163. As illustrated in FIG. 1B, the tip acute angle portion 1460 is positioned closer to the winding core portion 12 side than the first recessed corner portion 161.

Figure 2B:
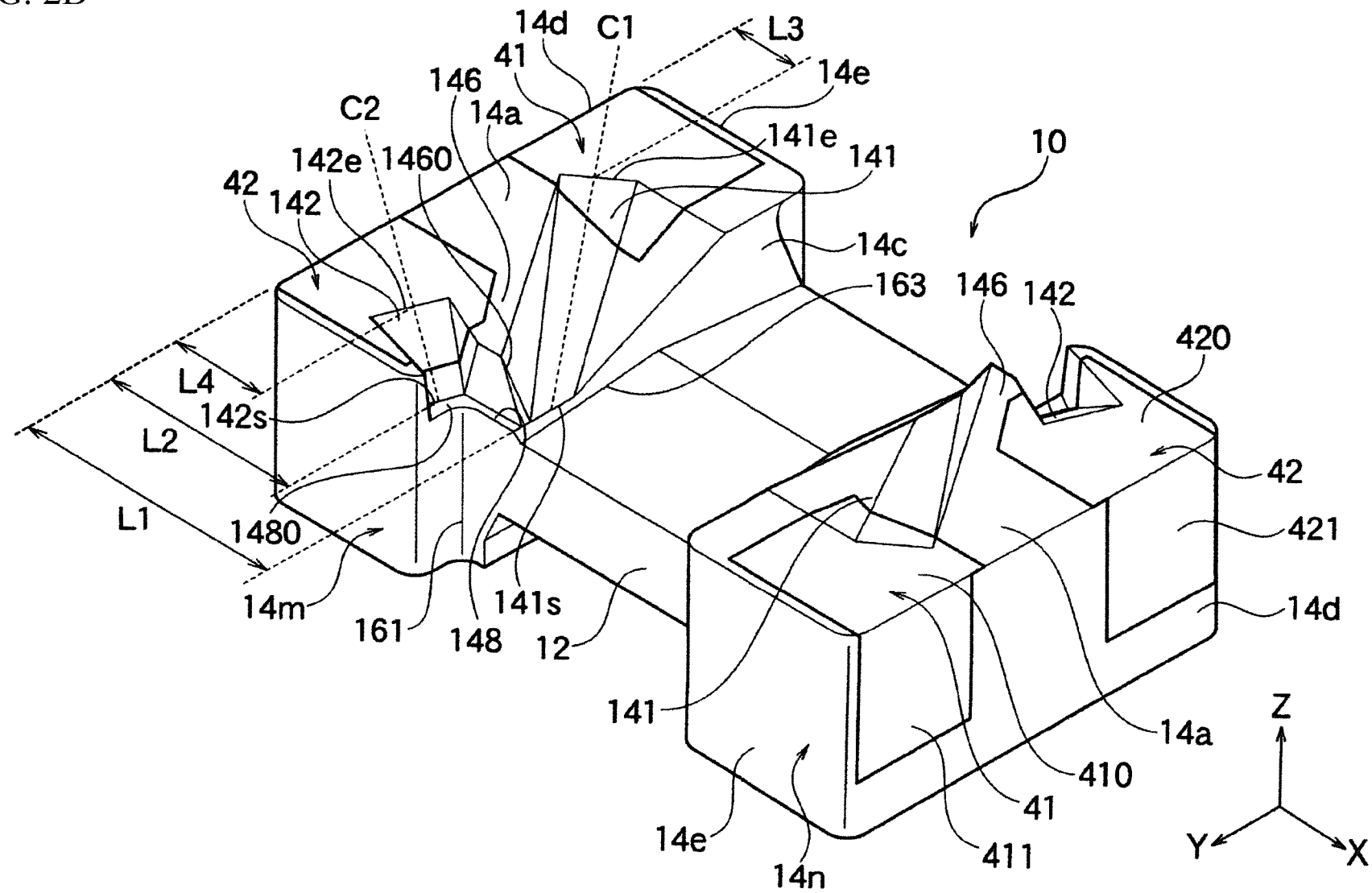
FIG. 2B is a perspective view illustrating a step subsequent to the step illustrated in FIG. 2A.

As illustrated in FIG. 2B, the first inclined portion 141 extends obliquely toward the outer side (outer end surface 14*d*) of the flange portion 14 and is inclined so as to gradually descend toward the inner end surface 14*c* side of the flange portion 14. An extension line C1 of the central axis of the first inclined portion 141 intersects with the outer end surface 14*d* of the flange portion 14 and intersects with the inner end surface 14*c* of the flange portion 14. The angle that is formed between the extension line C1 and the X axis is preferably 48 to 54°. The extension direction of the extension line C1 is substantially the same as the drawing direction of the first lead portion 310 drawn along the first inclined portion 141 (see FIG. 1A).

In the present embodiment, the first inclined portion 141 extends toward the Y-axis-direction end portion of the third recessed corner portion 163 and is inclined from the part toward the first terminal electrode 41. The first inclined portion 141 is formed in the range between the upper surface of the winding core portion 12 and the upper surface 14*a* of the flange portion 14.

As illustrated in FIG. 2A, the first inclined portion 141 has a groove shape (groove portion) and includes a first inclined surface 1410, a first wall side side surface 1411, and a first inclined side surface 1412. The first inclined surface 1410 is disposed so as to be sandwiched between the first wall side side surface 1411 and the first inclined side surface 1412. An inclined surface inclined from one Y-axis-direction end side (or the outer end surface 14*d*) of the flange portion 14 toward the other Y-axis-direction end side (or the inner end surface 14*c*) of the flange portion 14 forms the first inclined surface 1410.

The first wall side side surface 1411 constitutes a part of the wall portion 146 and is formed on the outer end surface 14*d* side of the first inclined surface 1410. The first inclined side surface 1412 is formed on the inner end surface 14*c* side of the first inclined surface 1410. An inclined surface inclined so as to gradually descend from one Y-axis-direction end side of the flange portion 14 toward the other Y-axis-direction end side of the flange portion 14 on the inner end surface 14*c* of the flange portion 14 forms the first inclined side surface 1412.

As illustrated in FIG. 2B, the second inclined portion 142 extends obliquely toward the outer side (outer end surface 14*d*) of the flange portion 14 at an angle different from the angle of the first inclined portion 141 and is inclined so as to gradually descend. An extension line C2 of the central axis of the second inclined portion 142 intersects with the outer end surface 14*d* of the flange portion 14, extends toward the first recessed corner portion 161, and intersects with a peripheral edge portion 1480 of a step surface 148 (described later). The angle that is formed between the extension line C2 and the X axis is preferably 18 to 24°. The extension direction of the extension line C2 is substantially the same as the drawing direction of the second lead portion 320 drawn along the second inclined portion 142 (see FIG. 1A).

As illustrated in FIG. 2A, the second inclined portion 142 has a groove shape (groove portion) and includes a second inclined surface 1420, a second wall side side surface 1421, and a second outer side side surface 1422. The second inclined surface 1420 is disposed so as to be sandwiched between the second wall side side surface 1421 and the second outer side side surface 1422. An inclined surface inclined from one Y-axis-direction end side (or the outer end surface 14*d*) of the flange portion 14 toward the other Y-axis-direction end side (or the inner end surface 14*c*) of the flange portion 14 forms the second inclined surface 1420.

The second wall side side surface 1421 constitutes a part of the wall portion 146 and is formed on the first lateral side surface 14*e* side of the second inclined surface 1420. The second outer side side surface 1422 is formed on the second lateral side surface 14*f* side of the second inclined surface 1420.

The first inclined portion 141 and the second inclined portion 142 become wide toward the outer side of the flange portion 14. It is preferable that the width of the first inclined surface 1410 of the first inclined portion 141 is approximately twice to five times the diameter of the first wire 31 or the second wire 32. The same applies to the width of the second inclined surface 1420 of the second inclined portion 142.

The step surface 148 is formed in the flange portion 14. The step surface 148, which has a substantially planar shape, is formed on the other end side of the third recessed corner portion 163 in the Y-axis direction (second lateral side surface 14*f* side) or at the upper end of the first recessed corner portion 161.

As illustrated in FIG. 2B, in the present embodiment, a second starting end 142*s* of the second inclined portion 142 is connected to the peripheral edge portion 1480 of the step surface 148. The second starting end 142*s* of the second inclined portion 142 corresponds to the intersection portion between the step surface 148 and the second inclined portion 142 (second inclined surface 1420). A second terminal end 142*e* of the second inclined portion 142 corresponds to the intersection portion between the upper surface 14*a* of the flange portion 14 and the second inclined portion 142 (second inclined surface 1420).

In addition, a first starting end 141*s* of the first inclined portion 141 corresponds to the intersection portion between the third recessed corner portion 163 and the first inclined portion 141 (first inclined surface 1410). A first terminal end 141*e* of the first inclined portion 141 corresponds to the intersection portion between the upper surface 14*a* of the flange portion 14 and the first inclined portion 141 (first inclined surface 1410).

The distance between the first terminal end 141*e* and the outer end surface 14*d* of the flange portion 14 along the extension line C1 and the distance between the second terminal end 142*e* and the outer end surface 14*d* of the flange portion 14 along the extension line C2 are approximately equal to each other. Preferably, the distances are 0.21 to 0.29 cm.

A distance L1 between the first starting end 141*s* of the first inclined portion 141 and the outer end surface 14*d* of the flange portion 14 and a distance L2 between the second starting end 142*s* of the second inclined portion 142 and the outer end surface 14*d* of the flange portion 14 are different from each other. L1 exceeds L2 in the present embodiment.

A distance L3 between the first terminal end 141*e* of the first inclined portion 141 and the outer end surface 14*d* of the flange portion 14 and a distance L4 between the second terminal end 142*e* of the second inclined portion 142 and the outer end surface 14*d* of the flange portion 14, which are different from each other, may be approximately equal to each other. In other words, the first terminal end 141*e* of the first inclined portion 141 and the second terminal end 142*e* of the second inclined portion 142 may be positioned on the same straight line passing through the upper surface 14*a* of the flange portion 14 and parallel to the outer end surface 14*d* of the flange portion 14.

As illustrated in FIG. 1A, in the present embodiment, the first lead portion 310 of the first wire 31 passes through the first inclined portion 141 of the flange portion 14*m* and the second lead portion 320 of the second wire 32 passes through the second inclined portion 142 of the flange portion 14*m*. In addition, the second lead portion 320 of the second wire 32 passes through the first inclined portion 141 of the flange portion 14*n* and the first lead portion 310 of the first wire 31 passes through the second inclined portion 142 of the flange portion 14*n*.

More specifically, as illustrated in FIGS. 1A and 2B, on the first flange portion 14*m* side, the first lead portion 310 of the first wire 31 is separated from the winding core portion 12 (or the coil portion 30) on the side surface side of the winding core portion 12 and is drawn obliquely along the inclined surface of the first inclined portion 141 from the Y-axis-direction end portion of the third recessed corner portion 163 toward the first terminal electrode 41 (or the outer end surface 14*d* of the flange portion 14).

In addition, on the first flange portion 14*m* side, the second lead portion 320 of the second wire 32 is separated from the winding core portion 12 (or the coil portion 30) on the side surface side of the winding core portion 12 (in the periphery including the first recessed corner portion 161) and then drawn (raised) to the upper end of the first recessed corner portion 161 along the first recessed corner portion 161. Then, the second lead portion 320 contactlessly passes over the step surface 148 and is drawn obliquely at an angle different from the angle of the first lead portion 310 toward the second terminal electrode 42 (or the outer end surface 14*d* of the flange portion 14) along the inclined surface of the second inclined portion 142. The periphery including the first recessed corner portion 161 refers to the first recessed corner portion 161 and the vicinity of the first recessed corner portion 161 and excludes, for example, the second lateral side surface 14*f* of the flange portion 14 and the substantially central portion of the winding core portion 12 in the X-axis direction.

In addition, on the second flange portion 14*n* side, the second lead portion 320 of the second wire 32 is separated from the winding core portion 12 (or the coil portion 30) on the side surface side of the winding core portion 12 and is drawn obliquely along the inclined surface of the first inclined portion 141 from the Y-axis-direction end portion of the third recessed corner portion 163 (not illustrated) toward the first terminal electrode 41 (or the outer end surface 14*d* of the flange portion 14).

In addition, on the second flange portion 14*n* side, the first lead portion 310 of the first wire 31 is separated from the winding core portion 12 (or the coil portion 30) on the side surface side of the winding core portion 12 (in the periphery including the first recessed corner portion 161) and then drawn (raised) to the upper end of the first recessed corner portion 161 along the first recessed corner portion 161. Then, the first lead portion 310 contactlessly passes over the step surface 148 and is drawn obliquely at an angle different from the angle of the first lead portion 310 toward the second terminal electrode 42 (or the outer end surface 14*d* of the flange portion 14) along the inclined surface of the second inclined portion 142.

In the periphery including the first recessed corner portion 161, each of the first lead portion 310 and the second lead portion 320 is disposed so as to be separated along the X-axis direction. As described above, in the present embodiment, the first recessed corner portion 161 positionally deviates to the outer end surface 14*d* side of the flange portion 14 by the distance that corresponds to the width W1C (see FIG. 1B) as compared with the second recessed corner portion 162. Accordingly, the second lead portion 320 as compared with a normal coil device is drawn along the first recessed corner portion 161 at a position positionally deviating to the outer end surface 14*d* side of the flange portion 14 by the distance that corresponds to the width W1C.

The second wire 32 may be aerial-wired from the step surface 148 to the front of the second terminal end 142*e* of the second inclined portion 142 and abut against the bottom (second inclined surface 1420) of the second inclined portion 142 in front of the second terminal end 142*e* of the second inclined portion 142.

When the coil device 1 is manufactured, the drum-type drum core 10 and the wires 31 and 32 are prepared first. Usable as the wires 31 and 32 is, for example, what is obtained by covering a core material made of a good conductor such as copper (Cu) with an insulating material made of imide-modified polyurethane or the like and covering the outermost surface with a thin resin film such as polyester.

Examples of the magnetic material constituting the drum core 10 include a magnetic material having a relatively high magnetic permeability such as Ni—Zn-based ferrite, Mn—Zn-based ferrite, and a metal magnetic material. The drum core 10 is produced by powder of the magnetic materials being molded and sintered. As illustrated in FIG. 2A, at that time, the drum core 10 is produced such that the first inclined portion 141 and the second inclined portion 142 are integrally formed in each portion of the flange portion 14. In addition, the production is performed such that the winding core portion 12 and the pair of flange portions 14 are integrally molded in the drum core 10 and the width of the flange portion 14 along the X-axis direction is different between one end side and the other end side of the flange portion 14 in the Y-axis direction.

Next, metal paste is applied to the flange portion 14 of the drum core 10 and baking is performed at a predetermined temperature. Then, electroplating or electroless plating is performed on the surface of the flange portion 14. Formed as a result are the first terminal electrode 41 and the second terminal electrode 42 illustrated in FIG. 2B.

Figure 2C:
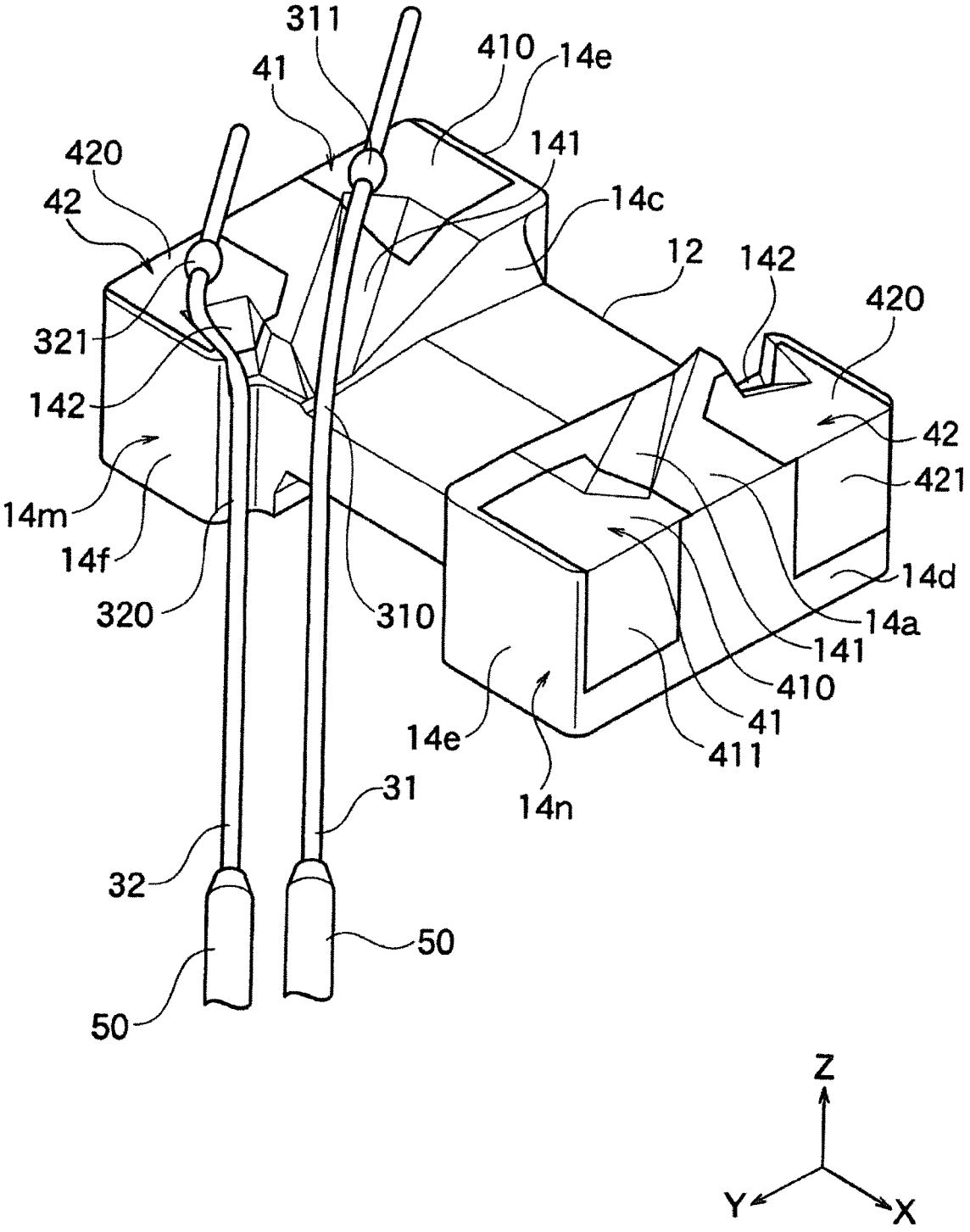
FIG. 2C is a perspective view illustrating a step subsequent to the step illustrated in FIG. 2B.

Next, the wires 31 and 32 and the drum core 10 where the terminal electrodes 41 and 42 are formed are set in a winding machine (not illustrated) and the first wire 31 (first lead portion 310) is drawn from the tip of a nozzle 50 as illustrated in FIG. 2C and connected to the first upper surface electrode portion 410 of the first terminal electrode 41. As a result, the first connecting portion 311 is formed at the connection part between the first upper surface electrode portion 410 and the first wire 31.

Simultaneously (or subsequently), the second wire 32 (second lead portion 320) is drawn from the tip of the nozzle 50 and connected to the second upper surface electrode portion 420 of the second terminal electrode 42. As a result, the second connecting portion 321 is formed at the connection part between the second upper surface electrode portion 420 and the second wire 32.

The method for the connection is not particularly limited. For example, the wires 31 and 32 are thermocompression-bonded to the terminal electrodes 41 and 42 by a heater chip being pressed such that the wires 31 and 32 are sandwiched between the terminal electrodes 41 and 42. The insulating material that covers the core wires of the wires 31 and 32 is melted by heat during the thermocompression bonding, and thus there is no need to perform film removal on the wires 31 and 32.

As illustrated in FIG. 1B, in the present embodiment, each of the wires 31 and 32 is thermocompression-bonded to the terminal electrodes 41 and 42 at a position equidistant from the outer end surface 14*d* of the flange portion 14 (position separated by the distance L5 from the outer end surface 14*d*). Since the thermocompression bonding position is aligned for each of the wires 31 and 32 as described above, each of the wires 31 and 32 can be thermocompression-bonded to the terminal electrodes 41 and 42 under appropriate fusion conditions and at a time without heater chip exchange or preparation of a plurality of heater chips. Accordingly, the reliability and workability of the thermocompression bonding can be enhanced.

Figure 2D:
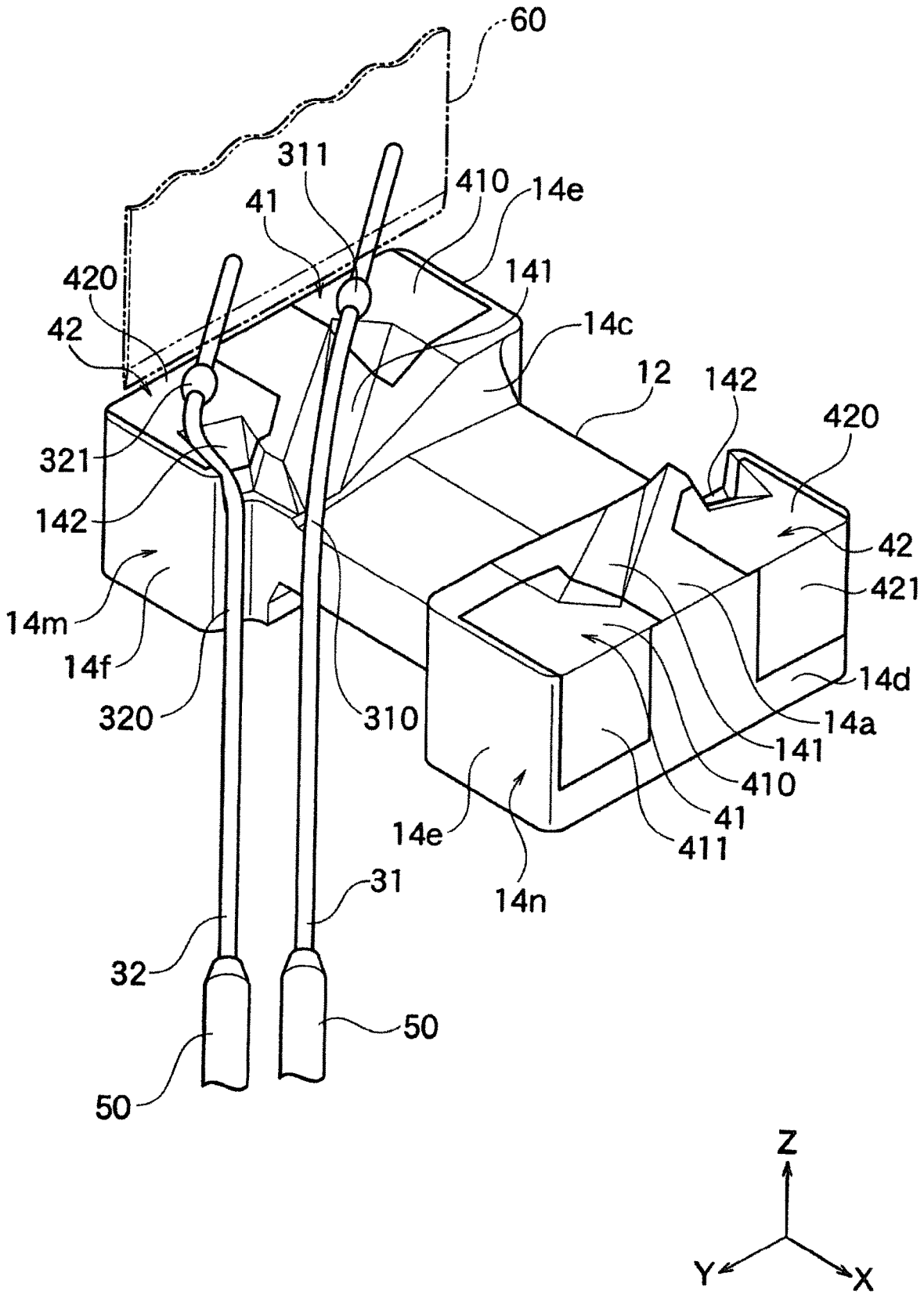
FIG. 2D is a perspective view illustrating a step subsequent to the step illustrated in FIG. 2C.

Next, as illustrated in FIG. 2D, unnecessary parts of the wires 31 and 32 (lead portions 310 and 320) protruding from the upper surface electrode portions 410 and 420 (first terminal electrodes 41 and 42) are cut by means of a cutting tool 60. During the cutting of the unnecessary parts of the lead portions 310 and 320, the cutting points of the lead portions 310 and 320 are disposed around the outer end surface 14*d* of the flange portion 14 and the cutting tool 60 is disposed (positioned) such that the side surface of the cutting tool 60 is substantially flush with the outer end surface 14*d*.

Then, at that position, the cutting tool 60 is lowered in the Z-axis direction along the outer end surface 14*d*. As a result, it is possible to cut the cutting points of the lead portions 310 and 320 without contact between the cutting tool 60 and the corner portion of the outer end surface 14*d* and the upper surface 14*a* of the flange portion 14 and it is possible to prevent damage to the flange portion 14.

In the present embodiment, each of the lead portions 310 and 320 is drawn toward the outer end surface 14*d* of the flange portion 14. Accordingly, it is possible to cut each of the lead portions 310 and 320 at a time by using the cutting tool 60 and workability can be enhanced.

Figure 2E:
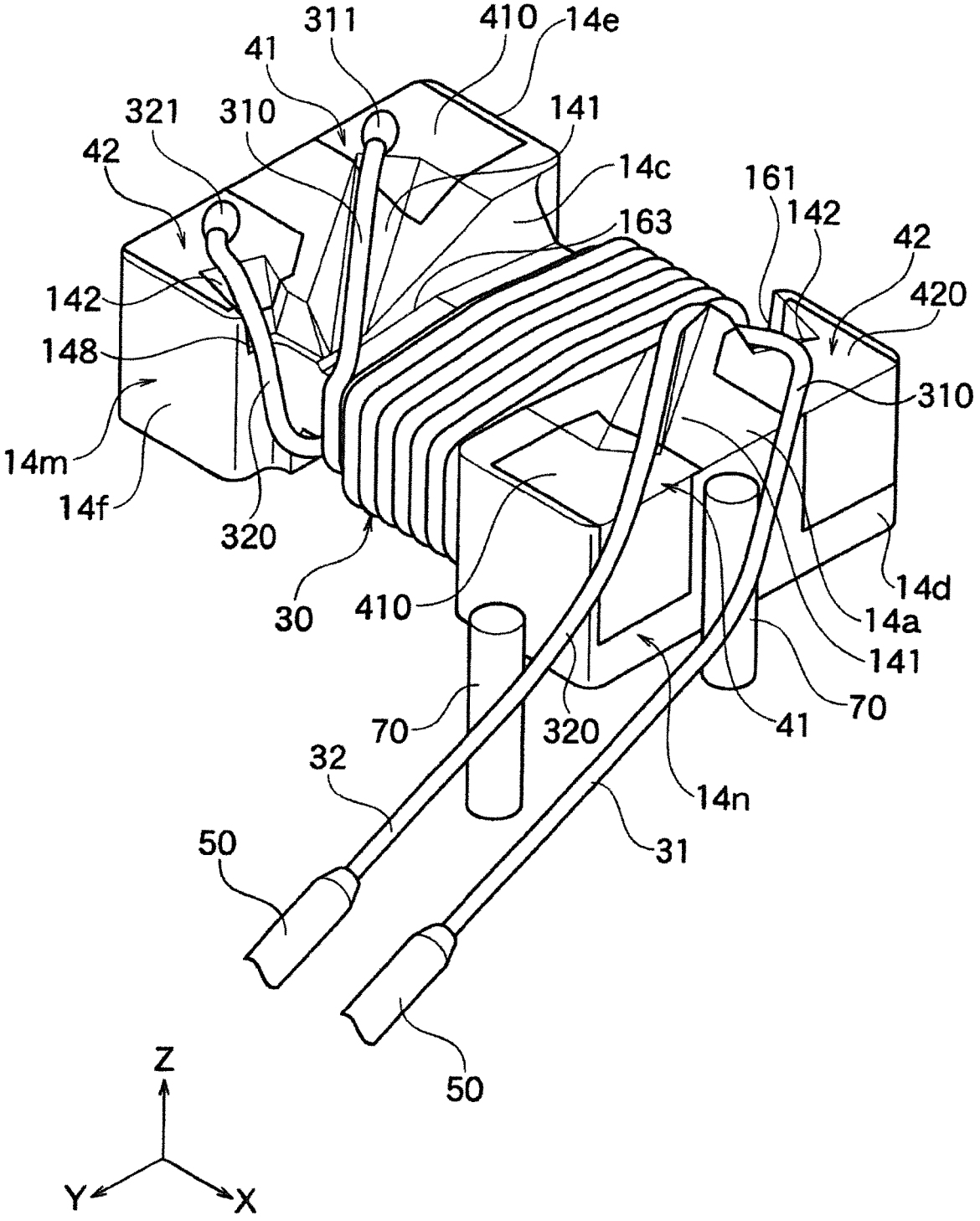
FIG. 2E is a perspective view illustrating a step subsequent to the step illustrated in FIG. 2D.

Next, as illustrated in FIG. 2E, on the first flange portion 14*m* side, the first wire 31 (first lead portion 310) is drawn obliquely toward the end portion of the third recessed corner portion 163 along the inclined surface of the first inclined portion 141. In addition, the second wire 32 (second lead portion 320) is drawn obliquely toward the upper end portion of the first recessed corner portion 161 along the inclined surface of the second inclined portion 142 and drawn to the lower end portion of the first recessed corner portion 161 along the first recessed corner portion 161. Subsequently, the coil portion 30 is formed by the wires 31 and 32 being wound around the winding core portion 12.

Then, on the second flange portion 14*n* side, the second wire 32 (second lead portion 320) is drawn obliquely from the end portion of the third recessed corner portion 163 (not illustrated) toward the first upper surface electrode portion 410 of the first terminal electrode 41 along the inclined surface of the first inclined portion 141. Subsequently, the second wire 32 (second lead portion 320) is hooked and fixed to a support column 70 so as not to loosen.

Simultaneously (or subsequently), the first wire 31 (first lead portion 310) is drawn from the lower end portion of the first recessed corner portion 161 toward the upper end portion of the first recessed corner portion 161 along the first recessed corner portion 161. Then, the drawn first wire 31 is drawn obliquely toward the second upper surface electrode portion 420 of the second terminal electrode 42 along the inclined surface of the second inclined portion 142. Subsequently, the first wire 31 is hooked and fixed to the support column 70 so as not to loosen.

Figure 2F:
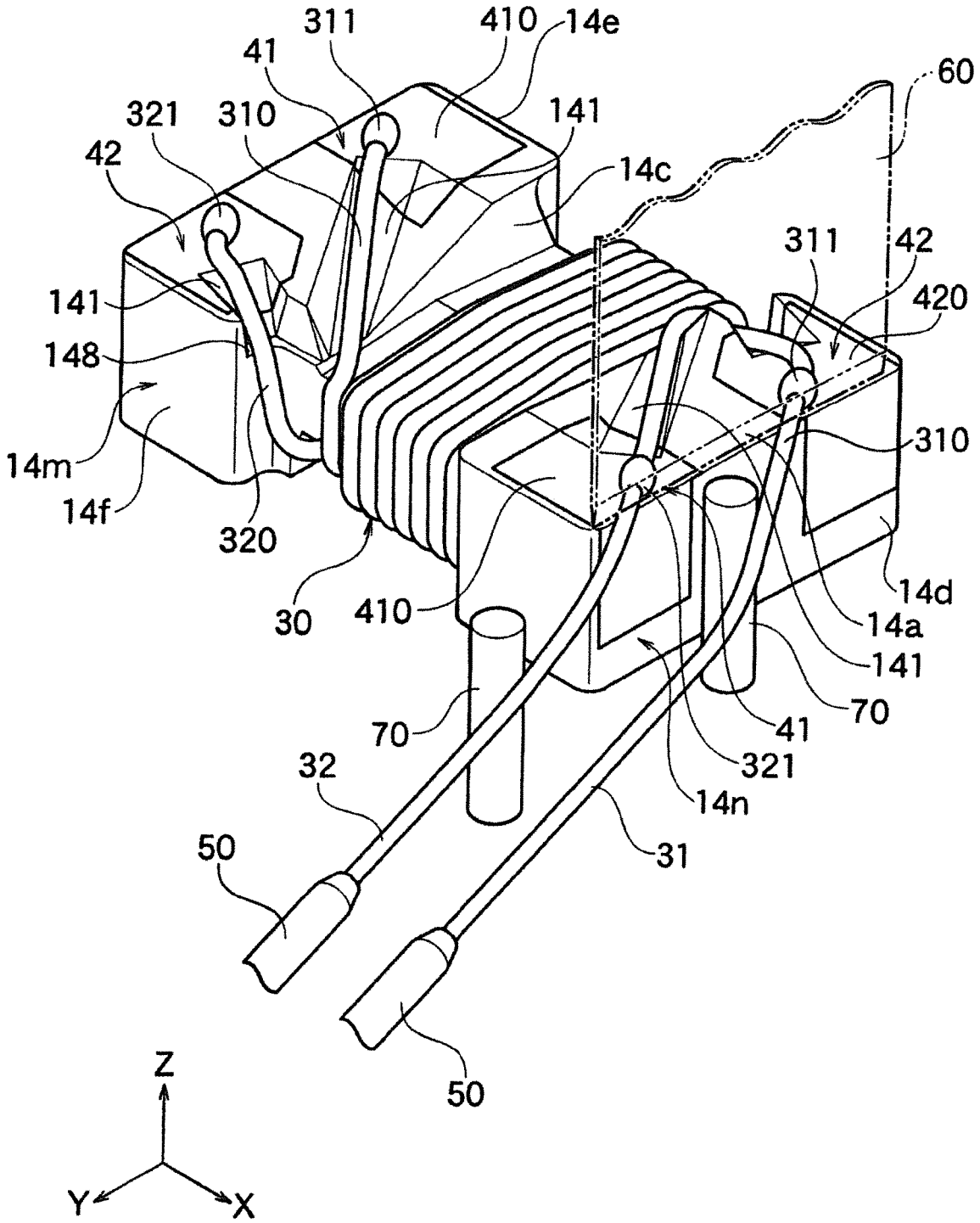
FIG. 2F is a perspective view illustrating a step subsequent to the step illustrated in FIG. 2E.

Next, the first wire 31 is connected to the second upper surface electrode portion 420 of the second terminal electrode 42 as illustrated in FIG. 2F. As a result, the first connecting portion 311 is formed at the connection part between the second upper surface electrode portion 420 and the first wire 31.

Simultaneously (or subsequently), the second wire 32 is connected to the first upper surface electrode portion 410 of the first terminal electrode 41. As a result, the second connecting portion 321 is formed at the connection part between the first upper surface electrode portion 410 and the second wire 32.

Next, as illustrated in FIG. 2Q unnecessary parts of the wires 31 and 32 (lead portions 310 and 320) protruding from the upper surface electrode portions 410 and 420 (terminal electrodes 41 and 42) are cut by means of the cutting tool 60 in the same manner as described with reference to FIG. 2D.

Figure 2G:
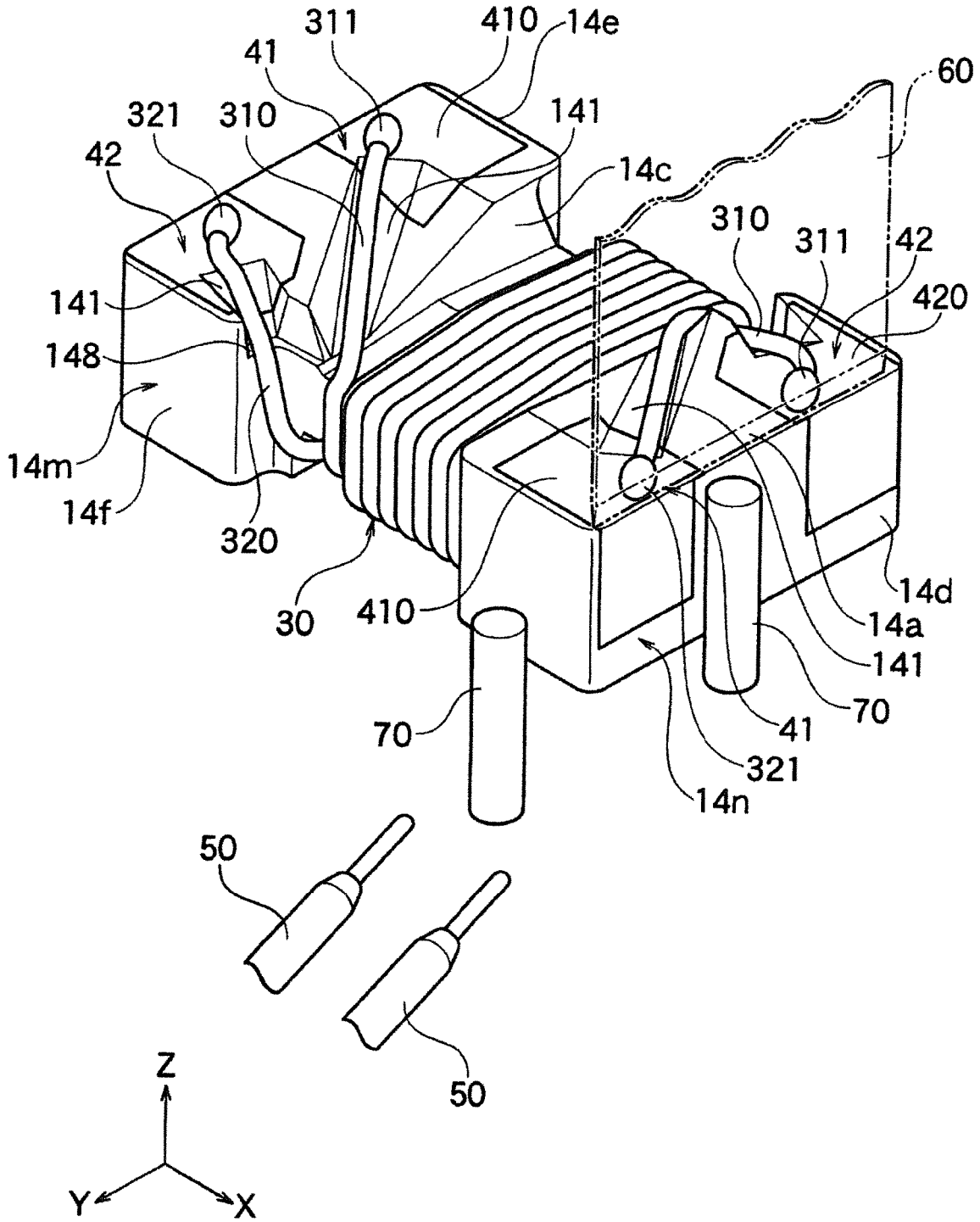
FIG. 2G is a perspective view illustrating a step subsequent to the step illustrated in FIG. 2F.
Figure 2H:
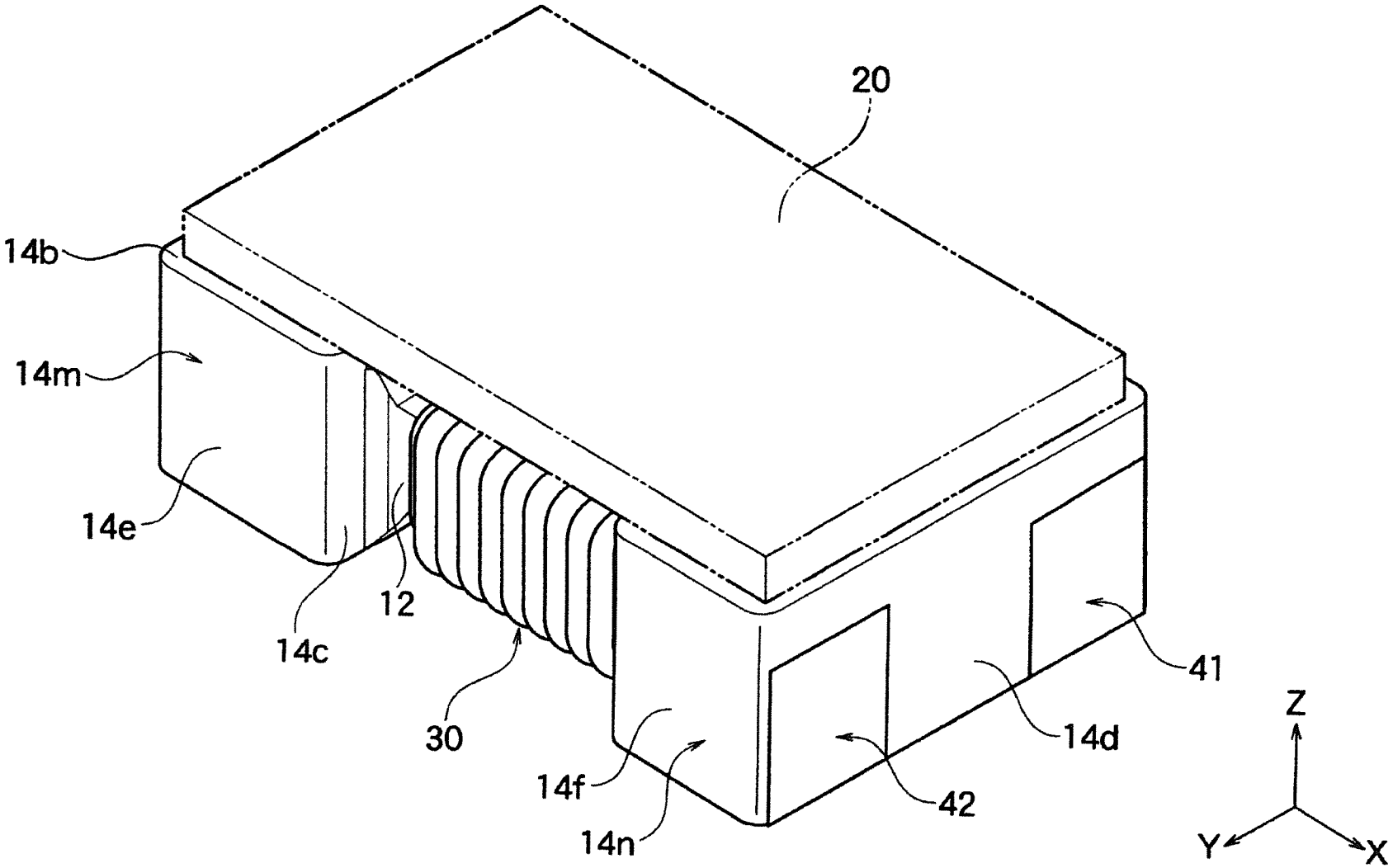
FIG. 2H is a perspective view illustrating a step subsequent to the step illustrated in FIG. 2G.

Next, as illustrated in FIG. 2H, a plate-shaped core 20 is installed on the lower surface 14*b* of the flange portion 14. A flat surface forms the lower surface 14*b*, and thus the plate-shaped core 20 is installed with ease. A flat rectangular parallelepiped having a flat surface forms the plate-shaped core 20 and the plate-shaped core 20 has a function of increasing the inductance of the coil device 1. Although it is preferable that the same magnetic material member as the drum core 10 constitutes the plate-shaped core 20, separate members may constitute the drum core 10 and the plate-shaped core 20. The plate-shaped core 20 does not necessarily have to be made of a magnetic material and may be made of a nonmagnetic material such as a synthetic resin.

As illustrated in FIG. 1B, in the present embodiment, the width of the flange portion 14 along the X-axis direction is different between one end side and the other end side of the flange portion 14 in the Y-axis direction. Accordingly, on the other end side of the flange portion 14 in the Y-axis direction, where the width along the X-axis direction is short, each of the first lead portion 310 and the second lead portion 320 can be drawn toward the respective terminal electrodes 41 and 42 in a state of being sufficiently pulled apart along the X-axis direction. Accordingly, on the other end side of the flange portion 14 in the Y-axis direction, it becomes difficult for the first lead portion 310 and the second lead portion 320 to come into contact with each other and it is possible to prevent the occurrence of short circuit inferiority between the lead portions 310 and 320.

In addition, as illustrated in FIG. 2A, in the present embodiment, the first recessed corner portion 161 positionally deviates to the outer end surface 14*d* side of the flange portion 14 along the X-axis direction as compared with the second recessed corner portion 162. Accordingly, in the periphery including the first recessed corner portion 161, each of the first lead portion 310 and the second lead portion 320 can be sufficiently pulled apart along the X-axis direction and it is possible to effectively prevent contact between the first lead portion 310 and the second lead portion 320.

In addition, in the present embodiment, the first inclined portion 141 and the second inclined portion 142 are formed in the flange portion 14, the first lead portion 310 heading for the first terminal electrode 41 passes through the first inclined portion 141, the second inclined portion 142 extends at an angle different from the angle of the first inclined portion 141, and the second lead portion 320 heading for the second terminal electrode 42 passes through the second inclined portion 142. Accordingly, the first lead portion 310 and the second lead portion 320 can be easily drawn toward the first terminal electrode 41 and the second terminal electrode 42 along the first inclined portion 141 and the second inclined portion 142.

Second Embodiment

Figure 4A:
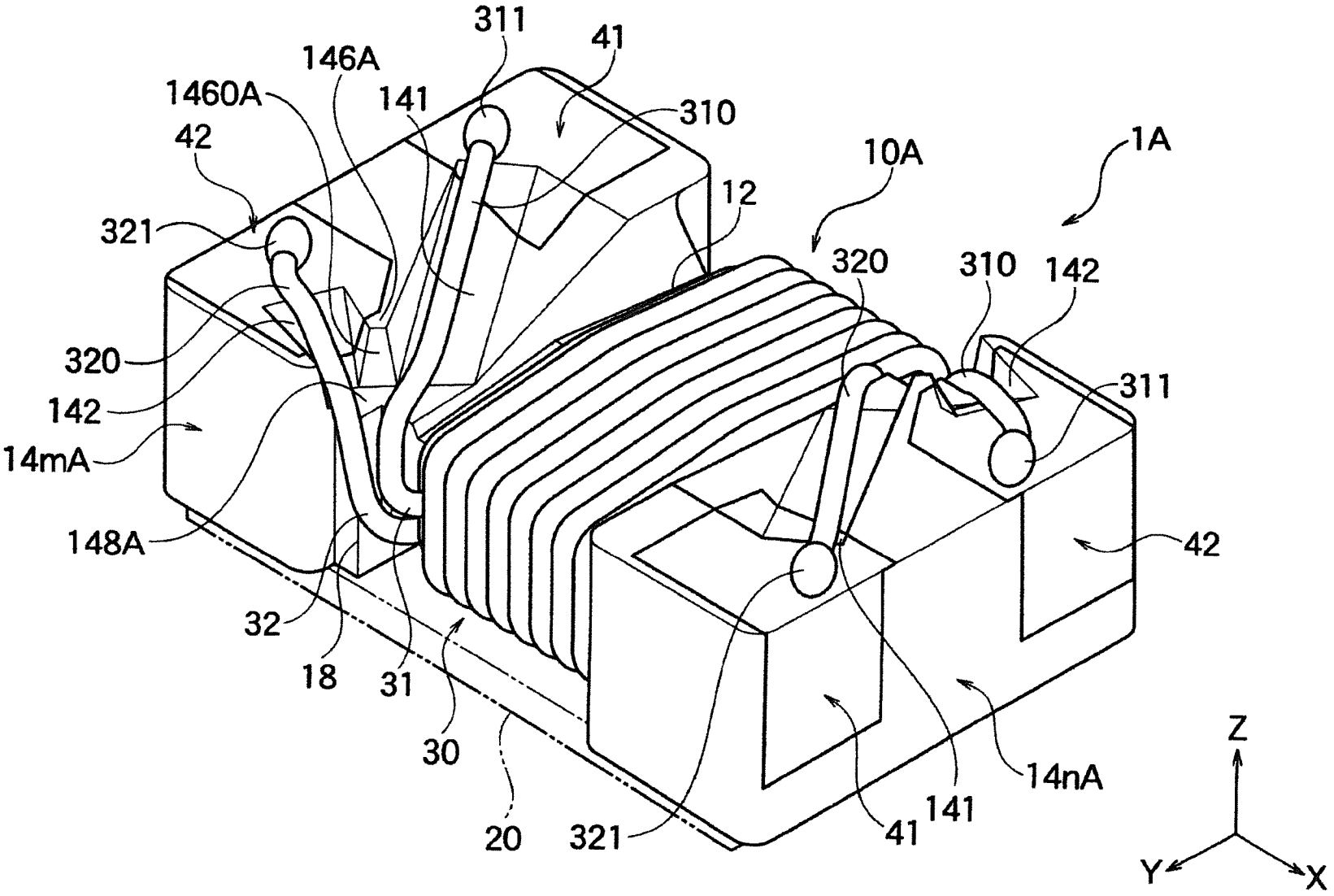
FIG. 4A is an overall perspective view of a coil device according to a second embodiment of the invention.
Figure 4B:
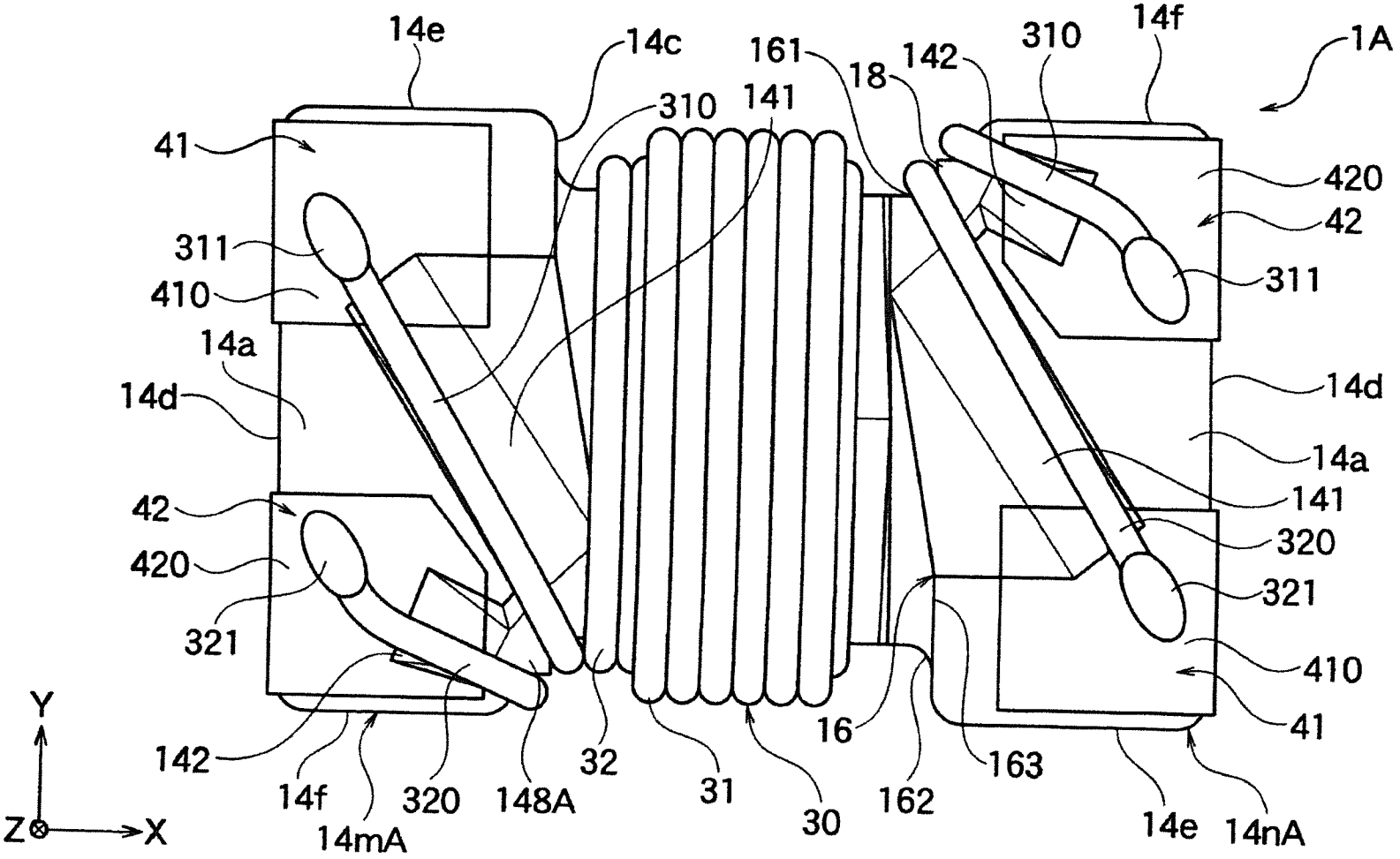
FIG. 4B is a plan view of the coil device illustrated in FIG. 4A.

A coil device 1A according to a second embodiment illustrated in FIGS. 4A and 4B is identical in configuration, action, and effect to the coil device 1 according to the first embodiment except for the following. In addition, members in the coil device 1A illustrated in FIGS. 4A and 4B correspond respectively to members in the coil device 1 according to the first embodiment illustrated in FIGS. 1A and 1B, the corresponding members will be denoted by the same reference numerals, and description of the members will be partially omitted.

As illustrated in FIGS. 4A and 4B, the coil device 1A includes a core 10A. The core 10A includes a first flange portion 14*m*A and a second flange portion 14*n*A. The first flange portion 14*m*A and the second flange portion 14*n*A have the same configuration. In the following description, the flange portions 14*m*A and 14*n*A will be collectively referred to as "flange portion 14A" in a case where it is not necessary to particularly distinguish the flange portions 14*m*A and 14*n*A.

Figure 5:
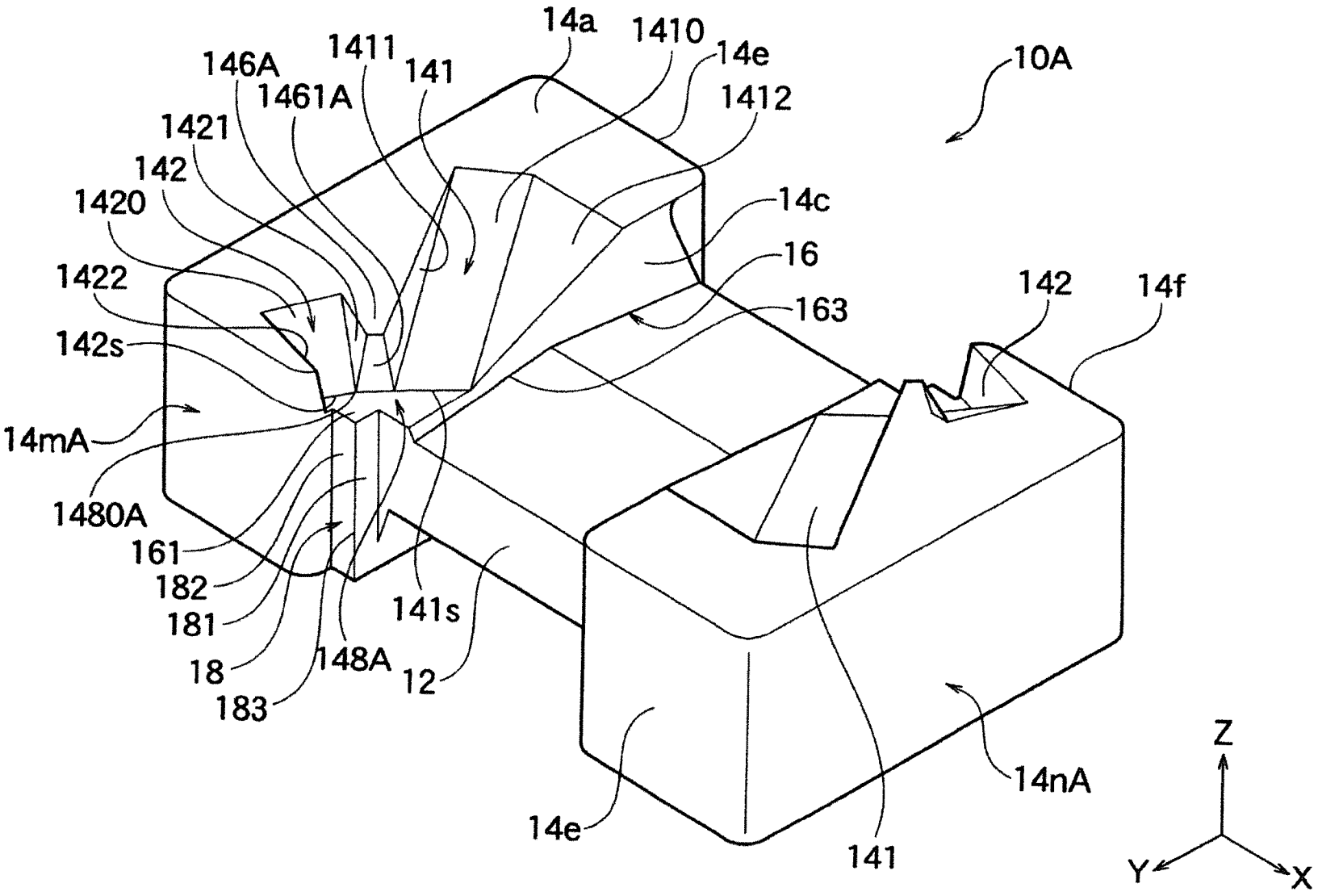
FIG. 5 is an overall perspective view of a core illustrated in FIG. 4A.

As illustrated in FIG. 5, a step surface 148A and a wall portion 146A are formed in the flange portion 14A. The step surface 148A is larger in area than the step surface 148 in the first embodiment illustrated in FIG. 2A. In the present embodiment, the first starting end 141*s* of the first inclined portion 141 and the second starting end 142*s* of the second inclined portion 142 are disposed in a peripheral edge portion 1480A of the step surface 148A so as to positionally deviate along the peripheral edge portion 1480A of the step surface 148A. The first starting end 141*s* of the first inclined portion 141 corresponds to the intersection portion between the step surface 148A and the first inclined portion 141 (first inclined surface 1410).

The wall portion 146A includes a tip surface 1461A. By the wall portion 146A being provided with the tip surface 1461A, it is possible to eliminate the tip acute angle portion 1460 of the wall portion 146 in the first embodiment illustrated in FIG. 2A. Accordingly, it is possible to prevent damage to the first wire 31 attributable to contact with the tip part (tip surface 1461A) of the wall portion 146A.

In the present embodiment, a projecting step portion 18 protruding outward from the core 10A is formed at the position of the first recessed corner portion 161. The step portion 18 linearly extends along the first recessed corner portion 161 and the extension direction of the step portion 18 and the height direction of the flange portion 14A (or the outer peripheral direction of the winding core portion 12) substantially coincide with each other. The upper end portion of the step portion 18 is positioned in the upper end portion of the first recessed corner portion 161. Although the lower end portion of the step portion 18 is positioned in the lower end portion of the flange portion 14A, the lower end portion of the step portion 18 may be positioned in the lower end portion of the first recessed corner portion 161. The step portion 18 (step side surfaces 181 and 182 to be described later) continuously extends between the upper and lower end portions of the first recessed corner portion 161.

The step portion 18 includes the first step side surface 181 and the second step side surface 182. A substantially flat surface forms the first step side surface 181 and the first step side surface 181 is formed on one side of the step portion 18 where the winding core portion 12 is positioned. A substantially flat surface forms the second step side surface 182 and the second step side surface 182 is formed on the other side of the step portion 18 where the flange portion 14A is positioned. Preferably, the width of the step side surfaces 181 and 182 is equal to or greater than the diameter of the wires 31 and 32. Preferably, the width is 0.06 cm or more. The first step side surface 181 and the second step side surface 182 intersect with each other in a step corner portion 183. In the step corner portion 183, an angle Θ formed by the first step side surface 181 and the second step side surface 182 satisfies $0° < \Theta < 180°$ (Θ has a value of approximately 90° in the present embodiment).

The step portion 18 is formed across the inner end surface 14*c* of the flange portion 14A and the side surface of the winding core portion 12 constituting the first recessed corner portion 161 and interconnects the side surface of the winding core portion 12 and the inner end surface 14*c* of the flange portion 14A. The first step side surface 181 is connected to the side surface of the winding core portion 12 at a substantially right angle (discontinuously) and a recessed corner portion is continuously formed at least between the upper and lower end portions of the first recessed corner portion 161 so as to straddle each of the surfaces. In addition, the second step side surface 182 is connected to the inner end surface 14*c* of the flange portion 14A at a substantially right angle (discontinuously) and a recessed corner portion is continuously formed at least between the upper and lower end portions of the first recessed corner portion 161 so as to straddle each of the surfaces.

As illustrated in FIGS. 4A and 5, on one side across the step portion 18 (side where the winding core portion 12 is disposed), a part of the first lead portion 310 is drawn toward the first terminal electrode 41 while being fixed to the first step side surface 181. More specifically, a part of the first lead portion 310 is drawn along the recessed corner portion that is formed by the first step side surface 181 and the side surface of the winding core portion 12.

On the other side across the step portion 18 (side where the flange portion 14A is disposed), a part of the second lead portion 320 is drawn toward the second terminal electrode 42 while being fixed to the second step side surface 182. More specifically, a part of the second lead portion 320 is drawn along the recessed corner portion that is formed by the second step side surface 182 and the inner end surface 14*c* of the flange portion 14A.

The first lead portion 310 is separated from the winding core portion 12 (or the coil portion 30) on the side surface side of the winding core portion 12 (in the periphery including the first recessed corner portion 161). Then, the first lead portion 310 is drawn to the first step side surface 181 as it is. Then, the first lead portion 310 is drawn (raised) to the upper end portion of the first recessed corner portion 161 along the first step side surface 181 while being fixed to the first step side surface 181. Further, the first lead portion 310 contactlessly passes over the step surface 148A and is drawn obliquely toward the first terminal electrode 41 along the first inclined portion 141. The first wire 31 may be aerial-wired from the step surface 148A to the front of the first terminal end 141*e* of the first inclined portion 141 and abut against the bottom (first inclined surface 1410) of the first inclined portion 141 in front of the first terminal end 141*e* of the first inclined portion 141.

The second lead portion 320 is separated from the winding core portion 12 (or the coil portion 30) on the side surface side of the winding core portion 12 (in the periphery including the first recessed corner portion 161). Then, the second lead portion 320 is drawn obliquely toward a longitudinal (height-direction) midway position of the step portion 18, temporarily straddles the step corner portion 183, and then is drawn to the second step side surface 182. Then, the second lead portion 320 is drawn (raised) to the upper end portion of the first recessed corner portion 161 along the second step side surface 182 while being fixed to the second step side surface 182 of the step portion 18. Further, the second lead portion 320 contactlessly passes over the step surface 148A and is drawn obliquely toward the second terminal electrode 42 along the second inclined portion 142.

In the present embodiment, the step portion 18 is formed at the position of the first recessed corner portion 161, the first lead portion 310 is drawn toward the first terminal electrode 41 on one side across the step portion 18, and the second lead portion 320 is drawn toward the second terminal electrode 42 on the other side across the step portion 18. Accordingly, in the first recessed corner portion 161, the first lead portion 310 and the second lead portion 320 are isolated via the step portion 18 and the first lead portion 310 and the second lead portion 320 are unlikely to come into contact with each other. Accordingly, it is possible to ensure a sufficient insulation between the first lead portion 310 and the second lead portion 320 and it is possible to prevent the occurrence of short circuit inferiority.

In addition, in the present embodiment, the step portion 18 extends along the first recessed corner portion 161. Accordingly, it is possible to form the step portion 18 over a wide range at the position of the first recessed corner portion 161 and it is possible to effectively ensure insulation between the first lead portion 310 and the second lead portion 320 via the step portion 18.

Third Embodiment

Figure 6A:
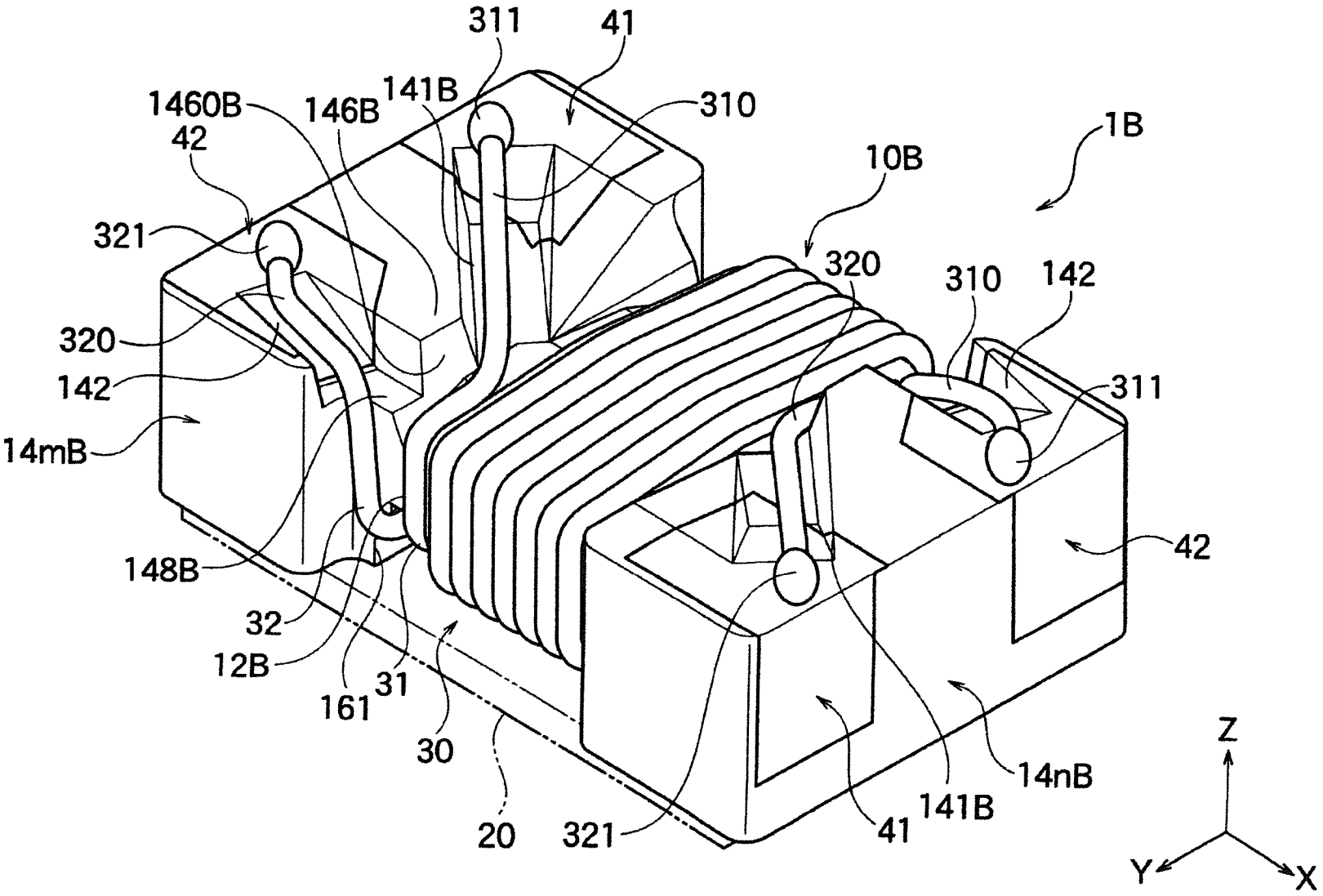
FIG. 6A is an overall perspective view of a coil device according to a third embodiment of the invention.
Figure 6B:
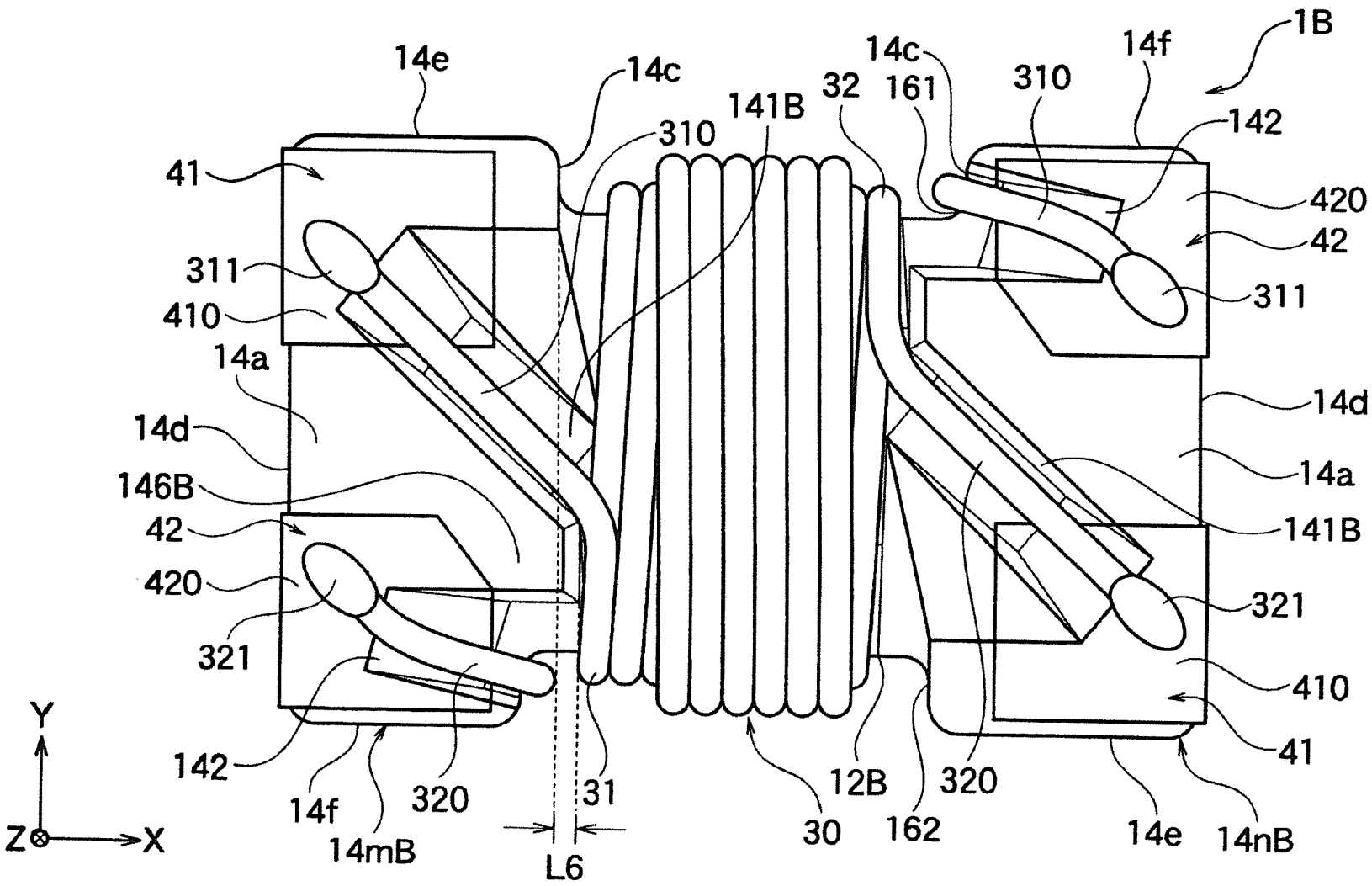
FIG. 6B is a plan view of the coil device illustrated in FIG. 6A.

A coil device 1B according to a third embodiment illustrated in FIGS. 6A and 6B is identical in configuration, action, and effect to the coil device 1 according to the first embodiment except for the following. In addition, members in the coil device 1B illustrated in FIGS. 6A and 6B correspond respectively to members in the coil device 1 according to the first embodiment illustrated in FIGS. 1A and 1B, the corresponding members will be denoted by the same reference numerals, and description of the members will be partially omitted.

As illustrated in FIGS. 6A and 6B, the coil device 1B includes a core 10B and a winding core portion 12B. The core 10B includes a first flange portion 14*m*B and a second flange portion 14*n*B. The first flange portion 14*m*B and the second flange portion 14*n*B have the same configuration. In the following description, the flange portions 14*m*B and 14*n*B will be collectively referred to as "flange portion 14B" in a case where it is not necessary to particularly distinguish the flange portions 14*m*B and 14*n*B.

Figure 7:
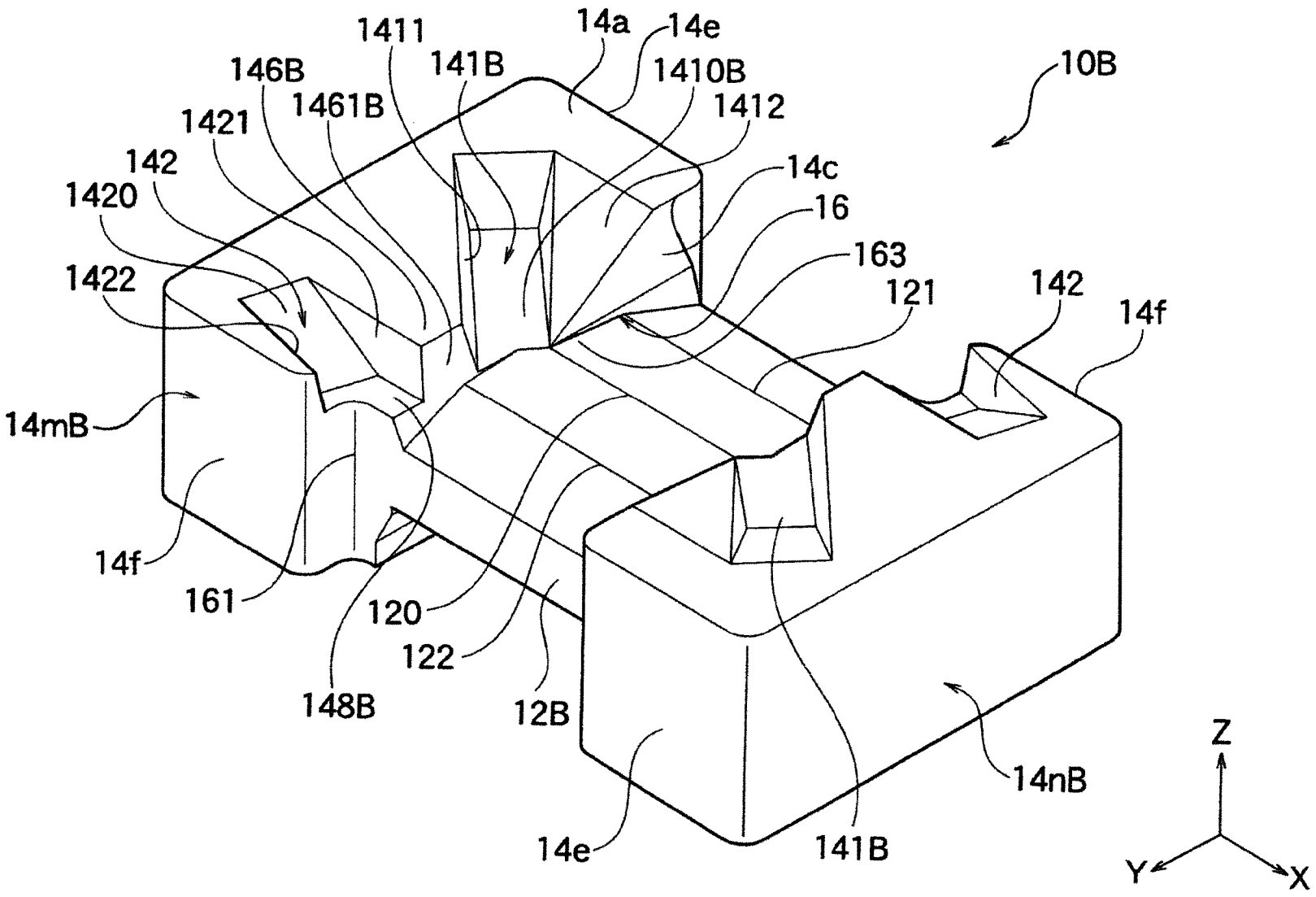
FIG. 7 is an overall perspective view of a core illustrated in FIG. 6A.

As illustrated in FIG. 7, a central protruding portion 120 is formed on the outer peripheral surface (upper surface) that is positioned in the substantially central portion of the winding core portion 12B in the Y-axis direction and a first protruding portion 121 and a second protruding portion 122 protruding outward in a projecting shape are formed on the outer peripheral surface (upper surface) that is positioned between the substantially central and end portions of the winding core portion 12B in the Y-axis direction. The first protruding portion 121 is formed between one end and the substantially central portion of the winding core portion 12B in the Y-axis direction and the second protruding portion 122 is formed between the other end and the substantially central portion of the winding core portion 12B in the Y-axis direction. The protruding portions 120 to 122 extend along the longitudinal direction of the winding core portion 12B.

Figure 8:
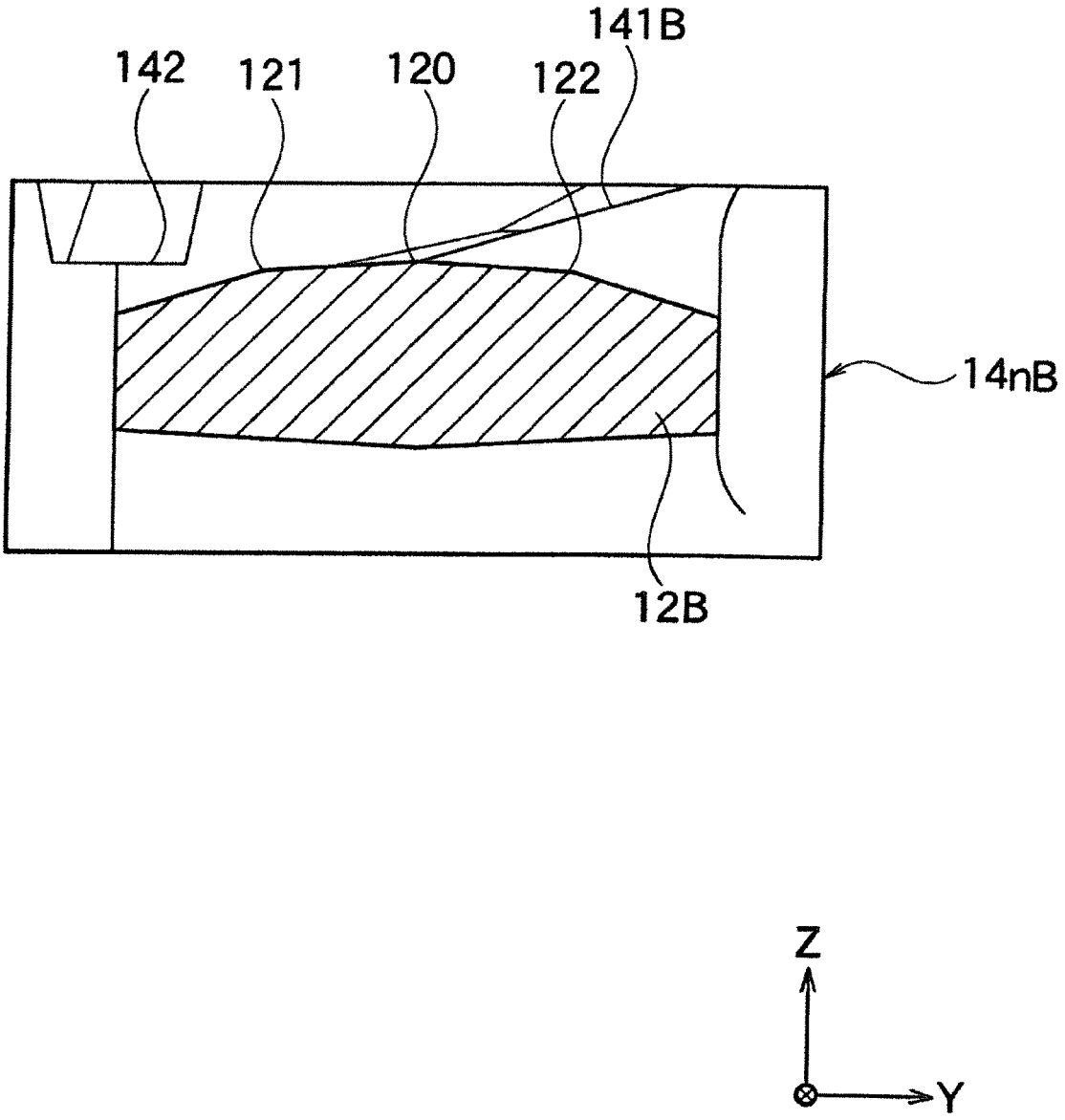
FIG. 8 is a cross-sectional view of the core (winding core portion) illustrated in FIG. 6A.

As illustrated in FIG. 8, in a case where the winding core portion 12B is provided with the protruding portions 121 and 122, a part of the outer peripheral surface (upper surface) that is positioned between the substantially central and end portions of the winding core portion 12B in the Y-axis direction protrudes outward in a projecting shape in the cross section of the winding core portion 12B. In addition, the upper surface of the winding core portion 12B is bent (has a corner) at the positions of the protruding portions 121 and 122 and a discontinuous surface is formed between the substantially central and end portions of the winding core portion 12B in the Y-axis direction. The inclination of the part of the upper surface of the winding core portion 12B that is between the protruding portions 121 and 122 and the end portion in the Y-axis direction is steeper than the inclination of the part between the protruding portions 121 and 122 and the central protruding portion 120.

The protruding portions 121 and 122 are formed only on the upper surface of the winding core portion 12B. No protruding portion is formed on the lower surface of the winding core portion 12B. By the plurality of protruding portions 121 and 122 being formed only on the upper surface of the winding core portion 12B, the winding core portion 12B has a substantially octagonal cross-sectional shape elongated in the Y-axis direction.

As illustrated in FIG. 7, a first inclined portion 141B, a step surface 148B, and a wall portion 146B are formed in the flange portion 14B. The first inclined portion 141B extends toward the substantially central portion of the winding core portion 12B in the Y-axis direction. More specifically, the first inclined portion 141B extends toward the part between the central protruding portion 120 and the second protruding portion 122 (the other end side in the Y-axis direction as compared with the central protruding portion 120). The first inclined portion 140B may extend toward the central protruding portion 120 or may extend toward the part between the central protruding portion 120 and the first protruding portion 121.

The wall portion 146B includes a tip surface 1461B. The tip surface 1461B constitutes a part of the inner end surface 14*c* of the flange portion 14B and is in the X-axis direction. The Y-axis-direction thickness of the wall portion 146B is larger than the Y-axis-direction thicknesses of the wall portion 146 in the first embodiment illustrated in FIG. 2A and the wall portion 146A in the second embodiment illustrated in FIG. 5.

In the present embodiment, a part of the wall portion 146B separating the first inclined portion 141B and the second inclined portion 142 from each other protrudes in the X-axis direction from the inner end surface 14*c* of the flange portion 14B. As illustrated in FIG. 6B, in a case where the protrusion length from the inner end surface 14*c* on one end side of the wall portion 146B in the Y-axis direction is L6, the ratio L6/W1A between the protrusion length L6 and the X-axis-direction width W1A (see FIG. 1B) on one end side of the flange portion 14B in the Y-axis direction is preferably ⅛ to 1/50.

As illustrated in FIGS. 6A and 7, the first lead portion 310 is separated from the winding core portion 12B on the outer peripheral surface between the other end and the substantially central portion of the winding core portion 12B in the Y-axis direction (more specifically, around the second protruding portion 122 illustrated in FIG. 7) and is drawn toward the first terminal electrode 41 along the first inclined portion 141B. In the present embodiment, the second protruding portion 122 is formed on the outer peripheral surface of the winding core portion 12B, and thus the first lead portion 310 is easily caught on the outer peripheral surface of the winding core portion 12B positioned around the second protruding portion 122 and the first lead portion 310 can be easily drawn from the part toward the first inclined portion 141.

The second lead portion 320 is separated from the winding core portion 12B (or the coil portion 30) on the side surface side of the winding core portion 12B (in the periphery including the first recessed corner portion 161) and then drawn (raised) to the upper end portion of the first recessed corner portion 161 along the first recessed corner portion 161. Further, the second lead portion 320 contactlessly passes over the step surface 148B and is drawn obliquely toward the second terminal electrode 42 along the second inclined portion 142.

In the present embodiment, the first inclined portion 141 extends toward the substantially central portion of the winding core portion 12B in the Y-axis direction. Accordingly, the first lead portion 310 can be drawn toward the first terminal electrode 41 away from the winding core portion 12B on the outer peripheral surface that is positioned between the substantially central and end portions of the winding core portion 12B in the Y-axis direction. Accordingly, each of the first lead portion 310 and the second lead portion 320 can be drawn toward the terminal electrodes 41 and 42 in a state of being sufficiently pulled apart along the Y-axis direction and contact between the first lead portion 310 and the second lead portion 320 can be effectively prevented.

In addition, in the present embodiment, the first lead portion 310 is drawn toward the first terminal electrode 41 away from the winding core portion 12B on the outer peripheral surface positioned between the substantially central and end portions of the winding core portion 12B in the Y-axis direction and the second lead portion 320 is drawn toward the second terminal electrode 42 away from the winding core portion 12B in the periphery including the first recessed corner portion 161. Accordingly, each of the first lead portion 310 and the second lead portion 320 is drawn at a different position along the Y-axis direction and contact between the first lead portion 310 and the second lead portion 320 can be effectively prevented.

In addition, in the present embodiment, a part of the wall portion 146B separating the first inclined portion 141B and the second inclined portion 142 from each other protrudes in the X-axis direction from the inner end surface 14*c* of the flange portion 14B. Accordingly, the first lead portion 310 is drawn toward the first inclined portion 141B so as to bypass a part of the wall portion 146B protruding from the inner end surface 14*c* of the flange portion 14B. Accordingly, each of the first lead portion 310 and the second lead portion 320 is sufficiently pulled apart and contact between the first lead portion 310 and the second lead portion 320 can be effectively prevented.

In addition, in the present embodiment, a part of the outer peripheral surface positioned between the substantially central and end portions of the winding core portion 12B in the Y-axis direction protrudes outward in a projecting shape in the cross section of the winding core portion 12B. Accordingly, the first lead portion 310 is easily drawn toward the first terminal electrode 41 from a part of the outer peripheral surface positioned between the substantially central and end portions of the winding core portion 12B in the Y-axis direction. In addition, since a part of the outer peripheral surface of the winding core portion 12B protrudes outward in a projecting shape, it is possible to ensure the cross-sectional area of the winding core portion 12B by the amount of the protrusion and the inductance characteristics of the coil device 1B can be improved.

The invention is not limited to the embodiments described above and can be variously modified within the scope of the invention.

In the first embodiment, the first lead portions 310 of the first wire 31 may be respectively connected to the first terminal electrode 41 of the first flange portion 14*m* and the first terminal electrode 41 of the second flange portion 14*n*. Likewise, the second lead portions 320 of the second wire 32 may be respectively connected to the second terminal electrode 42 of the first flange portion 14*m* and the second terminal electrode 42 of the second flange portion 14*n*. In this case, the positional relationship between the first wire 31 and the second wire 32 may be reversed from the example illustrated in FIG. 1A by, for example, causing the first wire 31 and the second wire 32 to intersect with each other (twisting the pair of wires 31 and 32) before or after the coil portion 30 is formed. The same applies to the second embodiment and the third embodiment.

In the first embodiment, the Y-axis-direction end portion of the flange portion 14 may be covered with the first upper surface electrode portion 410 by the range of the first upper surface electrode portion 410 illustrated in FIG. 1B being extended to the Y-axis-direction outer side of the flange portion 14. In addition, the Y-axis-direction end portion of the flange portion 14 may be covered with the first side surface electrode portion 411 by the range of the first side surface electrode portion 411 being extended to the Y-axis-direction outer side of the flange portion 14.

Likewise, the Y-axis-direction end portion of the flange portion 14 may be covered with the second upper surface electrode portion 420 by the range of the second upper surface electrode portion 420 being extended to the Y-axis-direction outer side of the flange portion 14. In addition, the Y-axis-direction end portion of the flange portion 14 may be covered with the second side surface electrode portion 421 by the range of the second side surface electrode portion 421 being extended to the Y-axis-direction outer side of the flange portion 14.

Figure 3:
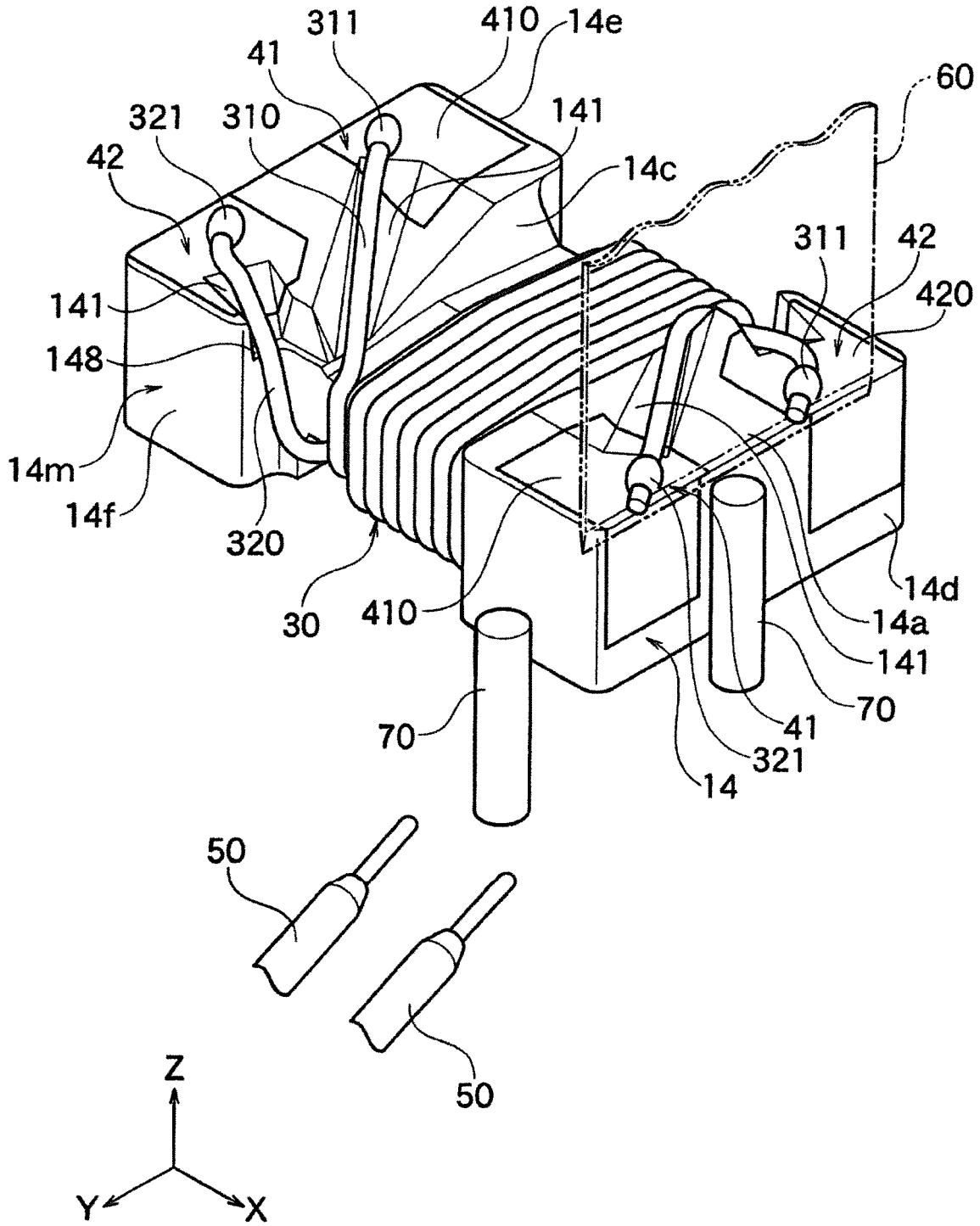
FIG. 3 is a perspective view illustrating a modification example of the step illustrated in FIG. 2G.

In the first embodiment, the cutting of the unnecessary parts of the wires 31 and 32 (lead portions 310 and 320) may be performed at a position separated in the X-axis direction from the outer end surface 14*d* of the flange portion 14 as compared with the position illustrated in FIG. 2G As illustrated in FIG. 3, at that time, the unnecessary parts of the wires 31 and 32 may remain ahead of the connecting portions 311 and 321.

Although the coil device 1 according to the first embodiment includes the two-layer coil portion 30 as illustrated in FIG. 1A, the number of layers of the coil portion 30 may be three or more or may be one. The same applies to the second embodiment and the third embodiment.

As illustrated in FIG. 2B, in the first embodiment, the extension lines C1 and C2 of the respective central axis of the first inclined portion 141 and the second inclined portion 142 intersect with the outer end surface 14*d* of the flange portion 14. Alternatively, the extension line C1 of the central axis of the first inclined portion 141 may intersect with the first lateral side surface 14*e* of the flange portion 14. In this case, the first wire 31 can be cut on the outer side of the flange portion 14 by the first wire 31 being drawn to the outside of the first lateral side surface 14*e* of the flange portion 14 and a cutting tool or the like being moved along the first lateral side surface 14*e* of the flange portion 14 after the wires 31 and 32 are connected to the terminal electrodes 41 and 42. The same applies to the second embodiment and the third embodiment.

As illustrated in FIG. 2A, in the first embodiment, a step surface having a substantially planar shape constitutes the step surface 148. Alternatively, a step surface formed of a curved surface may constitute the step surface 148. The same applies to the second embodiment and the third embodiment.

Exemplified in the first embodiment is a case where the first upper surface electrode portion 410 and the first side surface electrode portion 411 constitute the first terminal electrode 41 as illustrated in FIG. 2B. Alternatively, the first side surface electrode portion 411 may be omitted. Likewise, the second side surface electrode portion 421 may be omitted with regard to the second terminal electrode 42. The same applies to the second embodiment and the third embodiment.

Although the upper surface 14*a* of the flange portion 14 is a mounting surface in the first embodiment, the plate-shaped core 20 may be installed on the upper surface 14*a* with the lower surface 14*b* used as a mounting surface. The same applies to the second embodiment and the third embodiment.

As illustrated in FIG. 1B, in the first embodiment, the lead portions 310 and 320 are formed at positions separated by L5 from the outer end surface 14*d* of the flange portion 14. Alternatively, the lead portions 310 and 320 may be formed at positions separated by a predetermined distance from the terminal ends 141*e* and 142*e* of the inclined portions 141 and 142 illustrated in FIG. 2B. In this case, the contact lengths in the upper surface electrode portions 410 and 420 are equal for each of the lead portions 310 and 320 and each of the wires 31 and 32 can be thermocompression-bonded under appropriate fusion conditions and at a time, as in a case where the lead portions 310 and 320 are formed at positions separated by L5 from the outer end surface 14*d* of the flange portion 14, without heater chip exchange or preparation of a plurality of heater chips.

As illustrated in FIG. 2E, in the first embodiment, the wires 31 and 32 are hooked and fixed to the outer peripheral surface on one side (front side toward the page) of the support columns 70 and 70. Alternatively, the wires 31 and 32 may be hooked and fixed to the outer peripheral surface on the other side (back side toward the page) of the support columns 70 and 70.

In the second embodiment, the step portion 18 may intermittently extend between the upper and lower end portions of the first recessed corner portion 161. Alternatively, the step portion 18 may be formed only at a part between the upper and lower end portions of the first recessed corner portion 161.

In the second embodiment, the shape of the step portion 18 is not limited to the shape illustrated in FIG. 4A and may be changed as appropriate. For example, the first step side surface 181 and the second step side surface 182 may be continuously interconnected (may be integrated) with the step corner portion 183 omitted.

In the third embodiment, another protruding portion may be formed in addition to the protruding portions 121 and 122 on the upper surface of the winding core portion 12B.

What is claimed is:

1. A coil device comprising:

a core including:

a winding core portion; and a flange portion provided in an end portion of the winding core portion in a first direction, the flange portion having:

a first inclined portion;

a second inclined portion; and a wall portion separating the first inclined portion and the second inclined portion from each other, a tip of the wall portion being arranged so as to protrude inward in the first direction with respect to an inner end surface of a second end side of the flange portion;

a coil portion formed by a first wire and a second wire being wound around the winding core portion;

a first terminal electrode disposed on the flange portion at a first end side in a second direction substantially perpendicular to the first direction;

a second terminal electrode disposed on the flange portion at a second end side in the second direction;

a first lead portion of the first wire connected to the first terminal electrode, the first lead portion passing through the first inclined portion toward the first terminal electrode; and a second lead portion of the second wire connected to the second terminal electrode, the second lead portion passing through the second inclined portion toward the second terminal electrode, wherein a width of the flange portion along the first direction on the first end side of the flange portion is wider than that on the second end side of the flange portion.

2. The coil device according to claim 1, wherein a first recessed corner portion of a recessed corner portion where the winding core portion and the flange portion intersect with each other is configured to guide the first lead portion or the second lead portion, and is located closer to an outer end surface side of the flange portion along the first direction than a second recessed corner portion located on a side opposite to the first recessed corner portion across the winding core portion.

3. The coil device according to claim 2, wherein each of the first lead portion and the second lead portion is disposed so as to be separated along the first direction around the first recessed corner portion.

4. The coil device according to claim 2, further comprising:

a projecting step portion disposed at a position of the first recessed corner portion, wherein the first lead portion is drawn toward the first terminal electrode on one side of the step portion and the second lead portion is drawn toward the second terminal electrode on the other side of the step portion.

5. The coil device according to claim 3, further comprising:

a projecting step portion is disposed at a position of the first recessed corner portion, wherein the first lead portion is drawn toward the first terminal electrode on one side of the step portion and the second lead portion is drawn toward the second terminal electrode on the other side of the step portion.

6. The coil device according to claim 4, wherein the step portion extends along the first recessed corner portion.

7. The coil device according to claim 5, wherein the step portion extends along the first recessed corner portion.

8. The coil device according to claim 2, wherein the second inclined portion extends at an angle different from an angle of the first inclined portion.

9. The coil device according to claim 3, wherein the second inclined portion extends at an angle different from an angle of the first inclined portion.

10. The coil device according to claim 4, wherein the second inclined portion extends at an angle different from an angle of the first inclined portion.

11. The coil device according to claim 6, wherein the second inclined portion extends at an angle different from an angle of the first inclined portion.

12. The coil device according to claim 8, wherein the first inclined portion extends toward a substantially central portion of the winding core portion in the second direction.

13. The coil device according to claim 12, wherein the first lead portion extends toward the first terminal electrode and away from an outer peripheral surface of the winding core portion at a predetermined position, and the second lead portion extends away from the winding core portion and toward the second terminal electrode around the first recessed corner portion.

14. The coil device according to claim 1, wherein an inner end surface of the first end side of the flange portion is arranged inside the inner end face of the second end side of the flange portion in the first direction.

15. The coil device according to claim 12, wherein a part of an outer peripheral surface positioned between substantially central and end portions of the winding core portion in the second direction protrudes outward in a projecting shape in a cross section of the winding core portion.

16. The coil device according to claim 13, wherein a part of an outer peripheral surface positioned between substantially central and end portions of the winding core portion in the second direction protrudes outward in a projecting shape in a cross section of the winding core portion.

17. The coil device according to claim 1, wherein the first lead portion extends toward an outer end surface of the flange portion and is connected to the first terminal electrode, and the second lead portion extends toward an outer end surface of the flange portion at an angle different from an angle of the first lead portion and is connected to the second terminal electrode.

18. The coil device according to claim 2, wherein the first lead portion extends toward an outer end surface of the flange portion and is connected to the first terminal electrode, and the second lead portion extends toward an outer end surface of the flange portion at an angle different from an angle of the first lead portion and is connected to the second terminal electrode.

19. The coil device according to claim 3, wherein the first lead portion extends toward an outer end surface of the flange portion and is connected to the first terminal electrode, and the second lead portion extends toward an outer end surface of the flange portion at an angle different from an angle of the first lead portion and is connected to the second terminal electrode.

* * * * *